US009386833B2

(12) United States Patent
Hirose et al.

(10) Patent No.: US 9,386,833 B2
(45) Date of Patent: Jul. 12, 2016

(54) HEAD CARE APPARATUS

(71) Applicant: Panasonic Corporation, Osaka (JP)

(72) Inventors: Toshinori Hirose, Osaka (JP); Osamu Mizuno, Nara (JP); Soichiro Fujioka, Osaka (JP); Tohru Nakamura, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 141 days.

(21) Appl. No.: 14/354,105

(22) PCT Filed: May 29, 2013

(86) PCT No.: PCT/JP2013/003399
§ 371 (c)(1),
(2) Date: Apr. 24, 2014

(87) PCT Pub. No.: WO2013/179665
PCT Pub. Date: Dec. 5, 2013

(65) Prior Publication Data

US 2014/0259357 A1 Sep. 18, 2014

(30) Foreign Application Priority Data

May 30, 2012 (JP) ..... 2012-122725

(51) Int. Cl.
*A45D 19/14* (2006.01)

(52) U.S. Cl.
CPC ..... *A45D 19/14* (2013.01)

(58) Field of Classification Search
CPC ..... A45D 19/04; A45D 19/06; A45D 19/10; A45D 19/14; A45D 2019/005; A45D 2019/0058
USPC ..... 132/272; 4/517–519, 523, 661
See application file for complete search history.

(56) References Cited

U.S. PATENT DOCUMENTS 3,636,961 A * 1/1972 John ..... A45D 19/14 132/212
3,894,546 A * 7/1975 Nolan ..... A45D 19/00 132/212

(Continued)

FOREIGN PATENT DOCUMENTS

CN 1653983 A 8/2005
JP 6-21636 U 3/1994

(Continued)

OTHER PUBLICATIONS

Chinese Office Action and Search Report for corresponding Chinese Application No. 201380003109.4 dated Oct. 23, 2015 and English translation.

(Continued)

*Primary Examiner* — Paul R Durand
*Assistant Examiner* — Nicholas Ros
(74) *Attorney, Agent, or Firm* — Renner, Otto, Boisselle & Sklar, LLP

(57) ABSTRACT

A head care apparatus includes a unit base having independently rotatable first and second rotating shafts, a first link fixed on the first rotating shaft, a second link pivotally connected to the fist link, a third link fixed to the second rotating shaft, a fourth link pivotally connected to the third link, a support shaft pivotally connecting between the second and fourth links, an actuator supported by the support shaft, and an adjustment mechanism adjusting a posture of the actuator relative to person's head.

14 Claims, 17 Drawing Sheets

(56) References Cited

U.S. PATENT DOCUMENTS

| | | | | |
|---|---|---|---|---|
| 5,012,534 | A * | 5/1991 | McWhorter | A45D 19/10 132/212 |
| 5,906,012 | A * | 5/1999 | Sakane | A45D 19/14 4/515 |
| 2013/0145540 | A1 | 6/2013 | Mizuno et al. | |
| 2013/0152299 | A1 | 6/2013 | Mizuno et al. | |
| 2013/0160786 | A1 | 6/2013 | Fujioka et al. | |

FOREIGN PATENT DOCUMENTS

| | | | |
|---|---|---|---|
| JP | 6-078821 | A | 3/1994 |
| JP | 2001-149133 | A | 6/2001 |
| JP | 2003-245119 | A | 9/2003 |
| JP | 2010-178979 | A | 8/2010 |
| WO | WO 2012/023278 | A1 | 2/2012 |
| WO | WO 2012/039111 | A1 | 3/2012 |
| WO | WO 2012/039134 | A1 | 3/2012 |

OTHER PUBLICATIONS

International Preliminary Report on Patentability for corresponding International patent application No. PCT/JP2013-003399 dated Dec. 11, 2014 (English translation).

International Search Report for corresponding International Application No. PCT/JP2013/003399 mailed Aug. 20, 2013.

* cited by examiner

100

12L
12
115L
111L
125L
111R
105L
112
12R
102L
115R
109
110
103L
125R
105R
101
11
102R
103R
400
Z
Y
X

HEAD CARE APPARATUS

TECHNICAL FIELD

The present invention relates to a head care apparatus for use in a medical or cosmetic field, which is capable of caring person's heads automatically.

BACKGROUND OF THE INVENTION

Washing head is a typical head care treatment which needs human intervention and has been expected to be automated.

There has been known an automated head washing apparatus capable of washing human's heads automatically in, for example, a patent literature 1.

FIG. 17 is a diagram schematically showing a major part of the automated head washing apparatus indicated in a patent literature 1. As shown in the drawing, the automated head washing apparatus comprises a washing unit 1 having nozzles 1*a* and 2*a* positioned at regular intervals on an inner peripheral portion of the unit 1 for spraying cleaning liquid and water from the nozzles 1*a*, 2*a* against human's head and/or hair.

The washing unit 1 is moved in a direction indicated by arrow 4C by a reciprocating drive mechanism 4. The washing unit 1 and the reciprocating drive mechanism 4 are mounted on a support 5 which is driven by rotation mechanism 6 through gears.

By using the apparatus, the human's head and hair are capable of being washed automatically, reducing human interventions.

Patent Literature 1: JP 2001-149133 A

The above automated head washing apparatus uses nozzles fixed on a single washing unit for washing person's head, which may fail to wash person's heads of which surface configurations differ from the associated configuration of the washing unit.

A purpose of the invention is to provide a head care apparatus which is capable of washing person's heads in a reliable manner.

SUMMARY OF THE INVENTION

For this purpose, a head care apparatus of the invention comprises a first support for supporting a back of person's head;

a unit base including a first rotating shaft and a second rotating shaft, each of the first and second rotating shafts being rotatable independently;

a first link, one end of the first link being connected to the first rotating shaft;

a second link, one end of the second link being connected to the other end of the first link;

a third link, one end of the third link being connected to the second rotating shaft;

a fourth link, one end of the fourth link being pivotally connected to the other end of the third link;

an operation shaft pivotally connecting between the other end of the second link and the other end of the fourth link;

an actuator supported by the operation shaft for caring the person's head supported on the first support; and an adjustment mechanism adjusting a posture of the actuator relative to the person's head on the first support;

the adjustment mechanism comprising a connection shaft pivotally connecting between the third and fourth links;

a first adjustment member mounted on the connection shaft and fixed to the third link;

a second adjustment member rotatably connected to the operation shaft and fixed to the actuator; and an intermediate member connecting between the first and second adjustment members and causing the first and second adjustment members to rotate in a direction relative to the fourth link;

the posture of the actuator being adjusted by either one of or both of the rotations of the first and second rotating shafts.

A head care apparatus according to another embodiment of the invention comprises a first support for supporting a back of person's head;

a unit base including a first rotating shaft and a second rotating shaft, each of the first and second rotating shafts being rotatable independently;

a first link, one end of the first link being connected to the first rotating shaft;

a second link, one end of the second link being connected to the other end of the first link;

a third link, one end of the third link being connected to the second rotating shaft;

a fourth link, one end of the fourth link being pivotally connected to the other end of the third link;

an operation shaft pivotally connecting between the other end of the second link and the other end of the fourth link;

an actuator supported by the operation shaft for caring the person's head supported on the first support; and an adjustment mechanism adjusting a posture of the actuator relative to the person's head on the first support;

the adjustment mechanism comprising a connection shaft pivotally connecting between the third and fourth links;

a first adjustment link, one end of the first adjustment link being connected to the connection shaft and fixed to the third link;

a second adjustment link, one end of the second adjustment link being pivotally connected to the other end of the first adjustment link;

a third adjustment link, one end of the third adjustment link being pivotally connected to the other end of the second adjustment link and the other end of the third adjustment link being pivotally connected to the operation shaft; and an adjustment structure connecting between the actuator and the third adjustment link to restrict the posture of the actuator;

the posture of the actuator being adjusted by either one of or both of the rotations of the first and second rotating shafts.

Advantages of the Invention

According to the head care apparatus of the invention, the actuator for caring person's head is brought into contact with person's head in a reliable manner, which ensures a reliable treatment of the person's head.

EMBODIMENTS OF THE INVENTION

Figure 1:
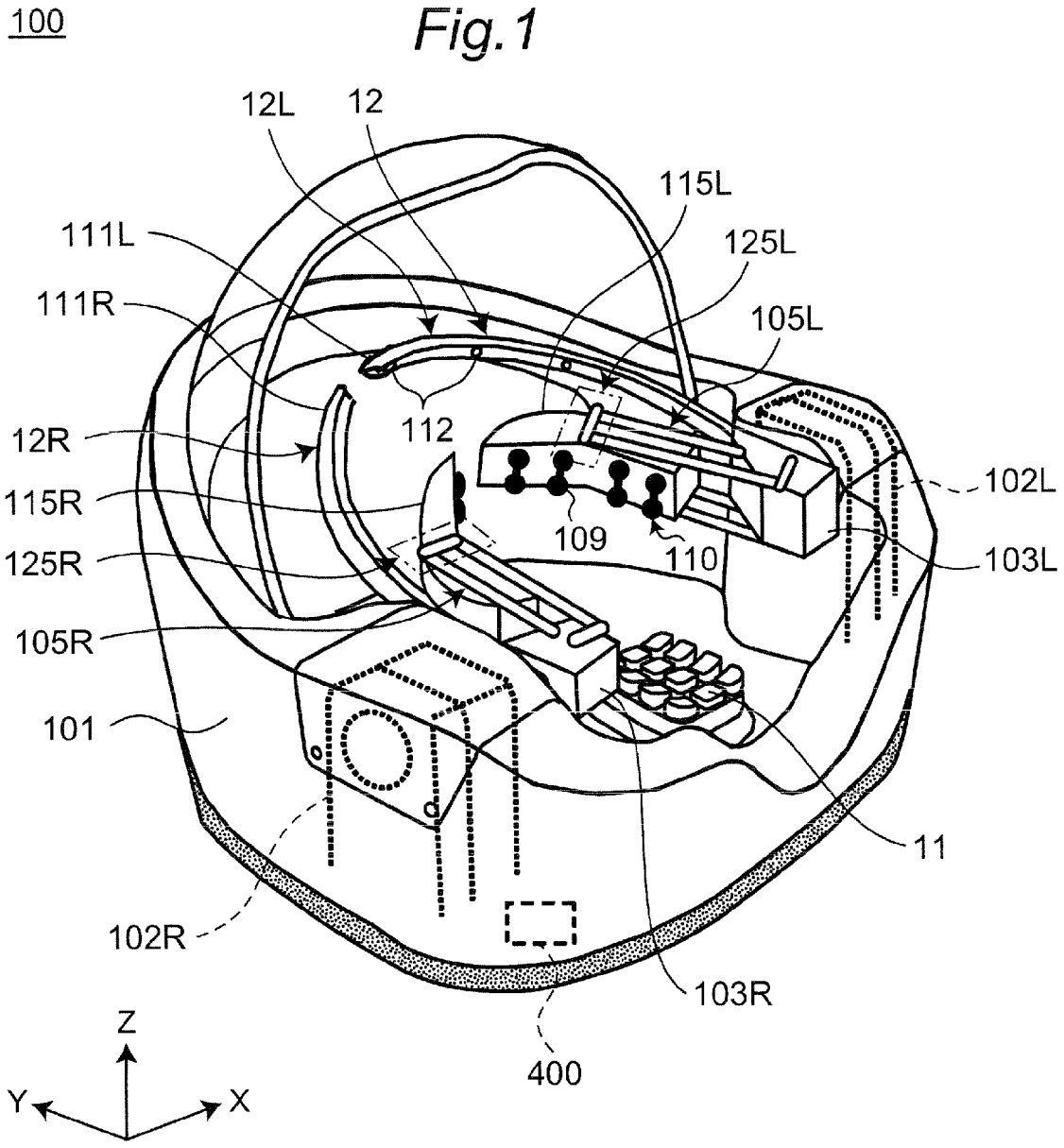
FIG. 1 is a perspective view of an automated hair washing apparatus according to the first embodiment of the invention.

With reference to the accompanying drawings, an embodiment of the present invention will be described below, in which like reference numbers are used to refer like parts and the same discussion is not duplicated for those parts. Also, for clarity of the drawings the members are schematically illustrated in the drawings. Further, X, Y, and Z coordinates are indicated in the drawings when appropriate, in which Z coordinate indicates a vertical direction and X and Y coordinates indicate respective directions orthogonal to the Z coordinate.

Following discussions will be made to an automated hair washing apparatus for person's heads. The automated hair washing apparatus is an example of the head care apparatus for caring human heads automatically. The "caring person's head" means at least one of washing human scalps and hairs and massaging person's heads. Also, in the following descriptions, directional terms "left", "right", "front", and "rear" indicates respective directions viewed from a person whose hair is being washed by the apparatus.

First Embodiment

Figure 2:
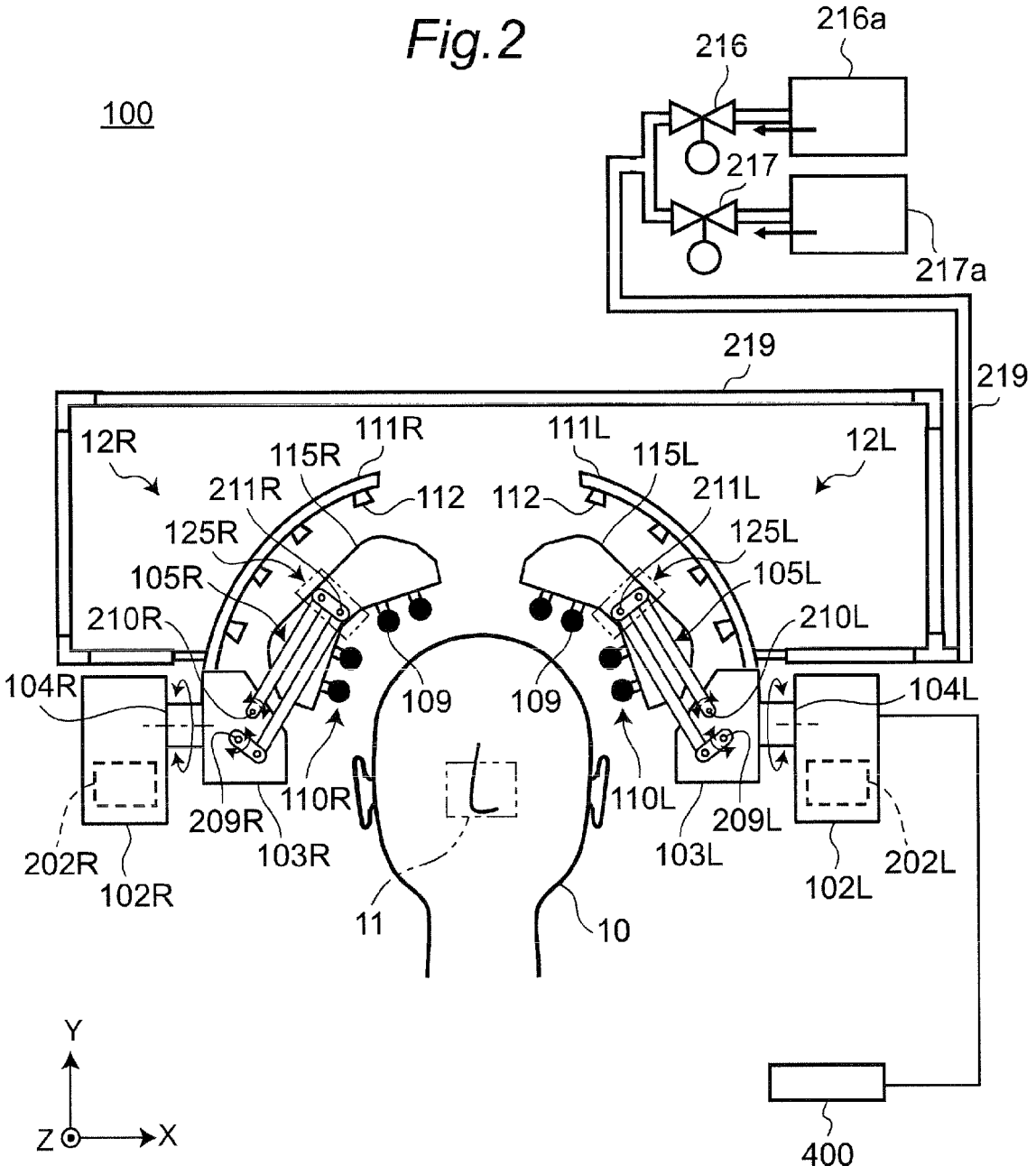
FIG. 2 is a diagram schematically showing a structure of the automated hair washing apparatus according to the first embodiment of the invention.
Figure 3:
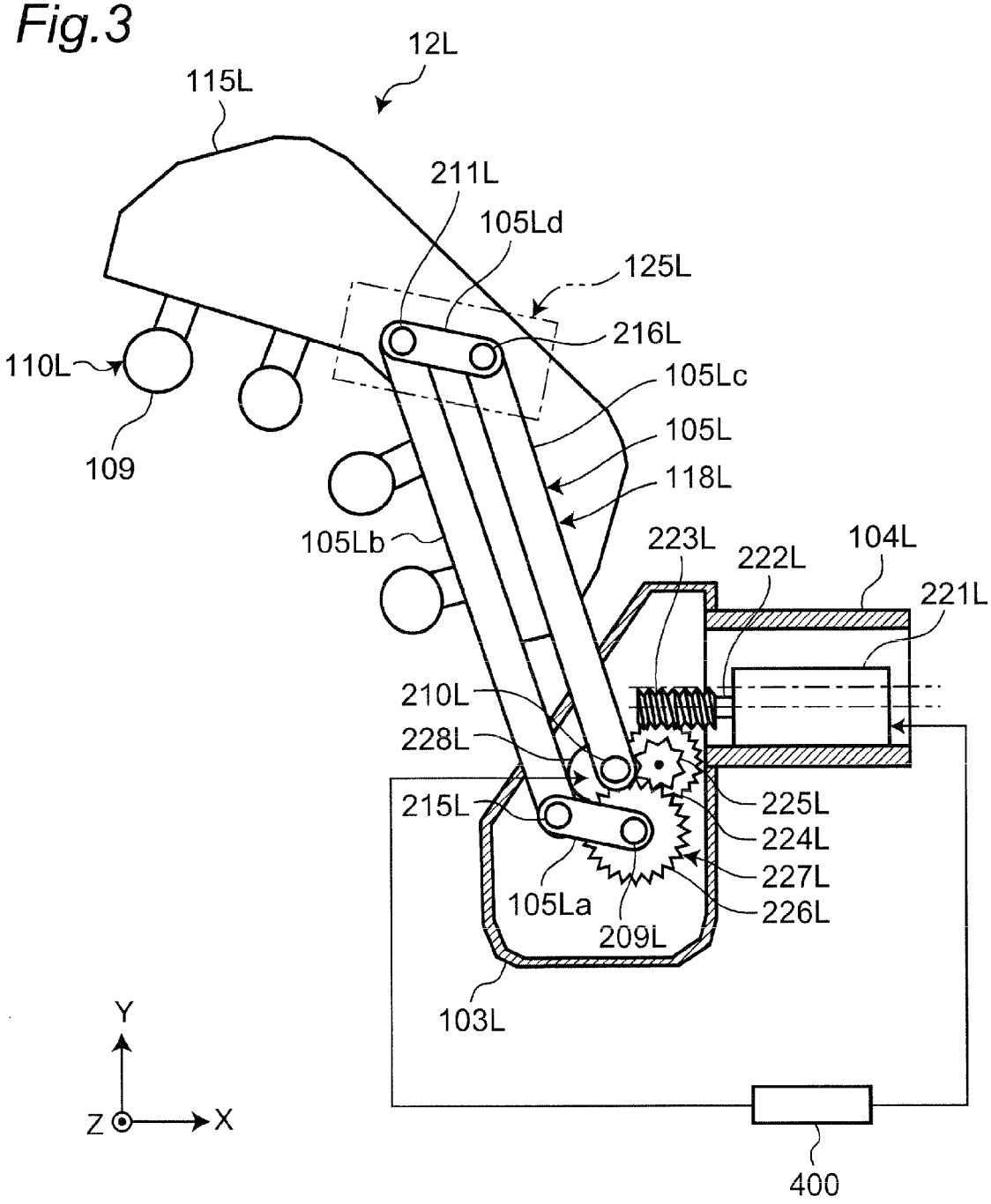
FIG. 3 is a partial cutout side view of the washing unit of the automated hair washing apparatus according to the first embodiment of the invention.
Figure 4:
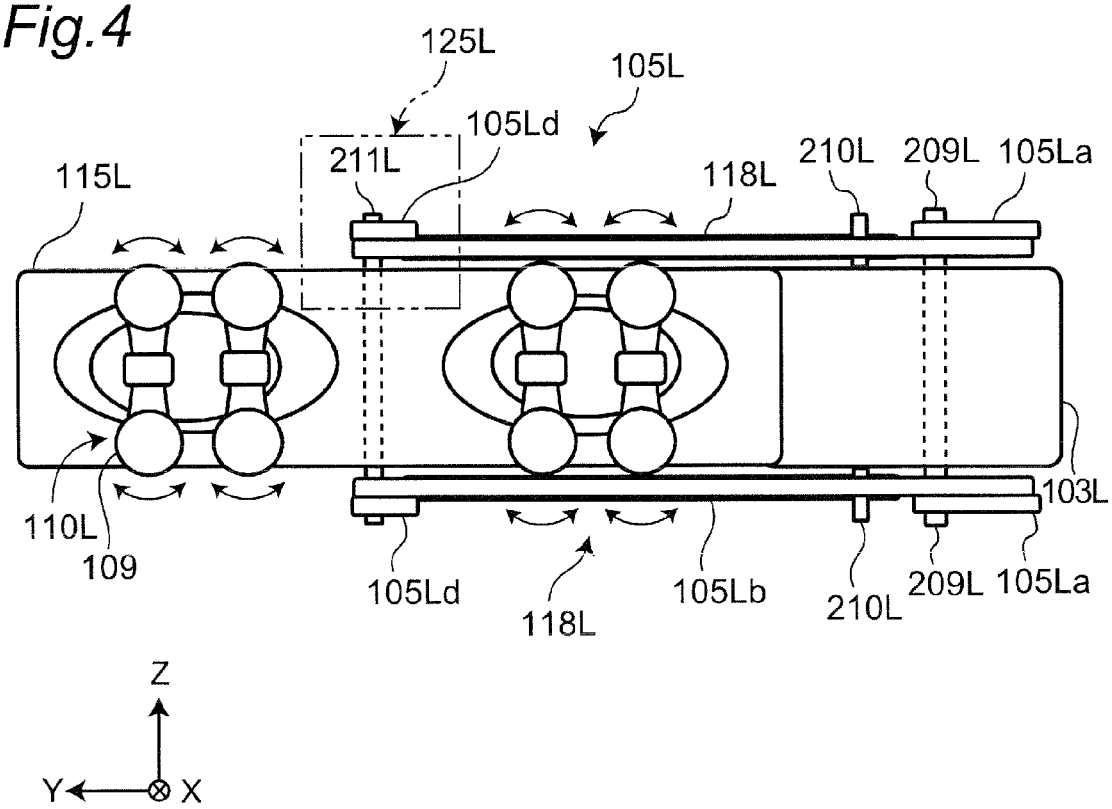
FIG. 4 is a diagram of the automated hair washing apparatus according to the first embodiment of the invention when viewed from a person whose hair is being washed by the apparatus.

FIG. 1 is a perspective view of the automated hair washing apparatus according to the first embodiment of the invention. FIG. 2 is a schematic view showing a structure of the automated hair washing apparatus according to the first embodiment of the invention. FIG. 3 is a partial cutout side elevation view showing a a washing unit of the automated hair washing apparatus according to the first embodiment of the invention. FIG. 4 is a diagram showing the washing unit of the automated hair washing apparatus according to the first embodiment of the invention, viewed from a person whose hair is being washed by the apparatus.

As shown in FIG. 1, the automated hair washing apparatus indicated at 100, according to the first embodiment of the invention, has a bowl 101. The bowl 101 comprises a first support 11 mounted thereinside. The first support 111 is an example of a member for supporting a back of the person's head. The bowl 101 is configured to surround substantially one half of the back surface of the person's head. Support columns 102L and 102R are mounted inside the bowl 101 on left and right sides of the first support 11.

The automated hair washing apparatus 100 comprises a pair of washing units 12 for washing the person's head 10 supported by the first support 11. The washing units 12 comprise a left washing unit 12L and a right washing unit 12R. The left and right washing units 12L and 12R are positioned on opposite sides of the support 11 within the bowl 101. In the following descriptions, the person's head 10 is indicated as being supported by the first support 11.

As shown in FIGS. 1 and 2, the washing unit 12L comprises an actuator 115L, an arm 105L, a unit base 103L, an adjustment mechanism 125L, a support shaft 104L, and a pipe 111L. The actuator 115L is one embodiment of actuator for caring person's heads 10. The arm 105L supports the actuator 115L and is connected to the unit base 103L. The adjustment mechanism 125L is to adjust the posture of the actuator 115L relative to the human's head 10. The support shaft 104L is connected to the unit base 103L. The pipe 111L is connected to the unit base 103L.

As shown in FIG. 2, the washing unit 12L is connected to the support column 102L through the support shaft 104L, allowing the washing unit 12L to rotate about the support shaft 104L.

A motor 202L, which is connected to the support shaft 104L, is mounted inside the column 102L, allowing the unit base 103L fixed on the support shaft 104L to rotate by the rotations transmitted from the motor 202L and then to the support shaft 104L. The motor 202L is controlled by a controller 400 controlling operation of the automated hair washing apparatus 100.

The pipe 111L of the washing unit 12L comprises a number of nozzles 112 ejecting shampoo liquid or water. The nozzles 112 are mounted on a portion of the pipe 111L opposing person's head 10. The pipe 111L is connected to the unit base 103L to rotate with the unit base 103L about the support shaft 104L.

As shown in FIG. 2, the automated hair washing apparatus 100 comprises a first valve 216 and a second valve 217. The first valve 216 is an embodiment of a valve used in a passage supplying shampoo liquid. The second valve 217 is an embodiment of a valve used in a passage supplying water. The outlets of the first and second valves 216 and 217 are connected through a passage 219 to the pipes 111L and 111R. The inlet of the first valve 216 is connected to a shampoo supply 216*a* so that the shampoo liquid is supplied from the shampoo supply 216*a* to the first valve 216. The inlet of the second valve 217 is connected to the water supply 217*a* so that the water is supplied from the water supply 217*a* to the second valve 217.

According to the automated hair washing apparatus 100, a controller 400 is provided for controlling the first and second valves 216 and 217, allowing the shampoo liquid and water to be ejected toward the person's head 10 from the nozzles 112 of the pipes 111L and 111R.

The actuator 115L of the washing unit 12L is supported for rotation by the support shaft 211L of the arm 105L. The actuator 115L is connected to the support shaft 211L through the adjustment mechanism 125L so that it is retained in a predetermined position relative to the support shaft 211L.

The actuator 115L comprises a contact portion 110L mounted on a side opposing the person's head 10. The contact portion 110L comprises a number of contacts 109 contacting and washing the person's head 10. In the first embodiment, the contact portion 110L has eight contacts 109. The contacts 109 are drivingly connected to a motor not shown which may be controlled by the controller 400 and mounted to the actuator 115L so that they swing as shown in FIG. 4. The contact 109 is an embodiment of a contact for caring person's head 10.

The arm 105L of the washing unit 12L comprises a first rotating shaft 209L and a second rotating shaft 210L each of which is capable of rotating independently.

As shown in FIG. 3, a first actuator or a rotating motor 221L is mounted inside the support shaft 104L of the washing unit 12L rotating the first rotating shaft 209L. The output shaft 222L of the motor 221L is positioned in parallel to the support shaft 104L. This arrangement ensures a further reduction in size of the automated hair washing apparatus 100 than another arrangement in which the motor 221L is mounted inside the unit base 103L.

A first motion conversion mechanism 227L is mounted inside the unit base 103L. The first motion conversion mechanism 227L is to convert the motion of the output shaft 222L of the motor 221L into a rotational movement of the rotating shaft 209L. The first motion conversion mechanism 227L comprises a worm 223L and a worm wheel 224L. The worm 223L is fixed on the output shaft 222L of the motor 221L.

This ensures that the first motion conversion mechanism 227L converts the rotational movement of the output 222L of the motor 221 into the rotational movement of the first rotating shaft 209L through worm 223L, worm wheel 224L, gear 225L, and gear 226L. The motor 221L may be controlled by the controller 400.

As described above, the first motion conversion mechanism 227L is a one-way conversion mechanism, or not a two-way conversion mechanism, made of worm 223L and worm wheel 224L.

The unit base 103 comprises a motor 228L mounted therein, which serves as a second actuator rotating the second rotating shaft 210L. Also, the unit base 103L comprises a second motion conversion mechanism not shown for concerting the rotational movement of the motor 228L into another rotational movement of the second rotating shaft 210L. The second motion conversion mechanism is adapted to convert the rotational movement of the motor 228L into the rotational movement of the second rotating shaft 210L and vice versa.

The arm 105L comprises two five-bar link mechanisms 118L and a support shaft 211L. The two five-bar link mechanisms 118L have the same structure and, as shown in FIG. 4, are positioned on opposite sides of the actuator 115L and in parallel to each other. The support shaft 211L connects the five-bar link mechanisms 118L with each other and rotatably supports the actuator 115L. The support shaft 211L is an embodiment of a shaft supporting the actuator 115L.

The five-bar link mechanism 118L comprises a first link 105La, a second link 105Lb, a third link 105Lc, and fourth link 105*d*. The first link 105La is connected at one end thereof to the first rotating shaft 209L. The second link 105Lb is pivotally connected at one end thereof with the other end of the first link 105La through the support shaft 215L. The third link 105Lc is connected at one end thereof with the second rotating shaft 210L. The fourth link 105Ld is pivotally connected at one end thereof with the other end of the third link 105Lc. The other ends of the second link 105Lb and the fourth link 105Ld are pivotally connected with each other through the support shaft 211L. The support shaft 216L is an embodiment of a shaft pivotally connecting between the third and fourth links 105Lc and 105Ld.

Figure 5:
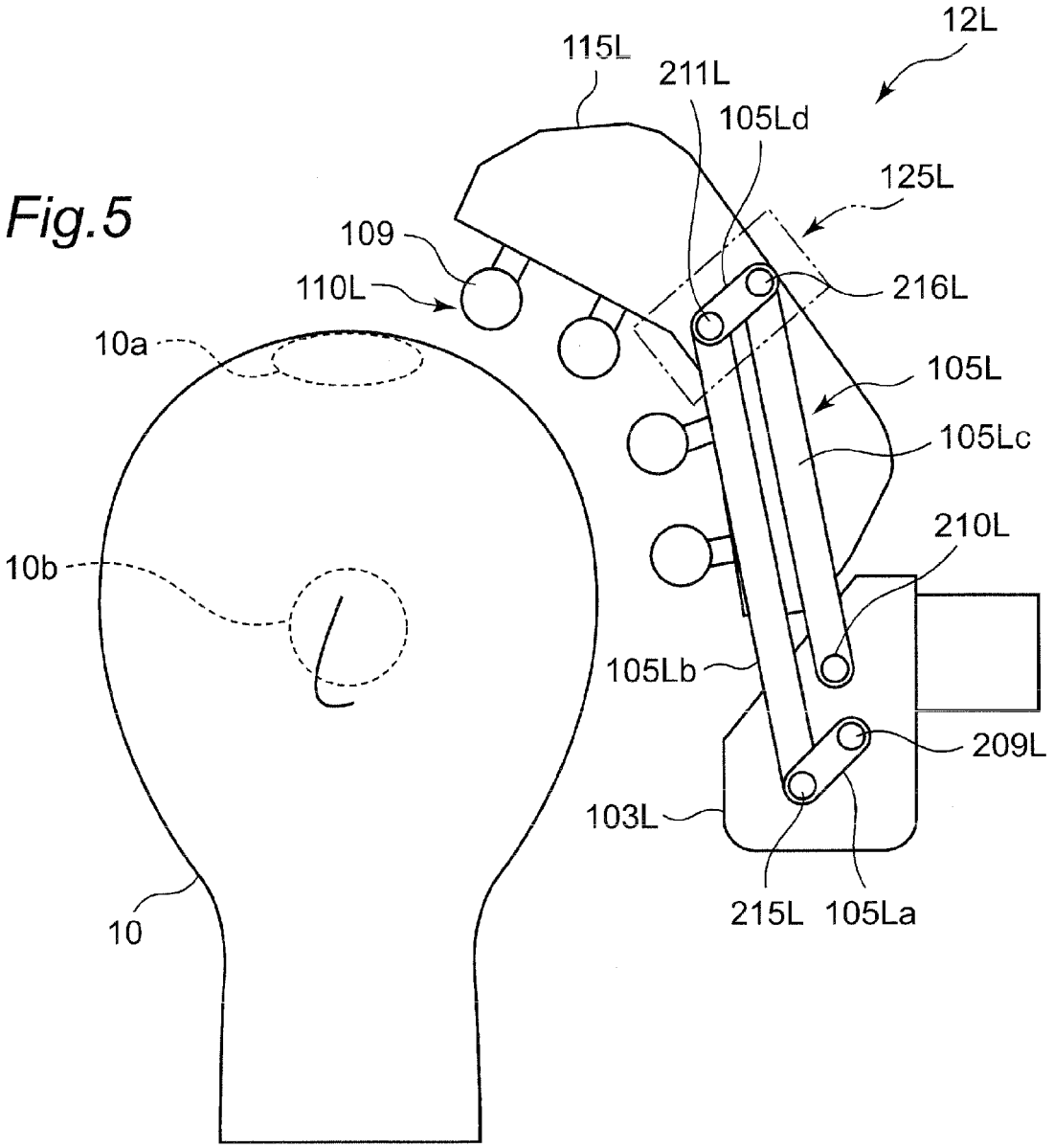
FIG. 5 is a diagram showing an initial state of the washing unit of the automated hair washing apparatus according to the first embodiment of the invention.

FIG. 5 is a diagram showing the washing unit when the automated hair washing apparatus takes an initial state. As shown in the drawing, before washing the person's head 10, the washing unit 12L is placed in a predetermined initial posture in which the actuator 115L does not interfere with the person's head 10. The controller 400 controls the posture of the actuator 115L based upon the rotational movements of the first and second rotating shafts 209L and 210L by the controller 400.

Figure 6:
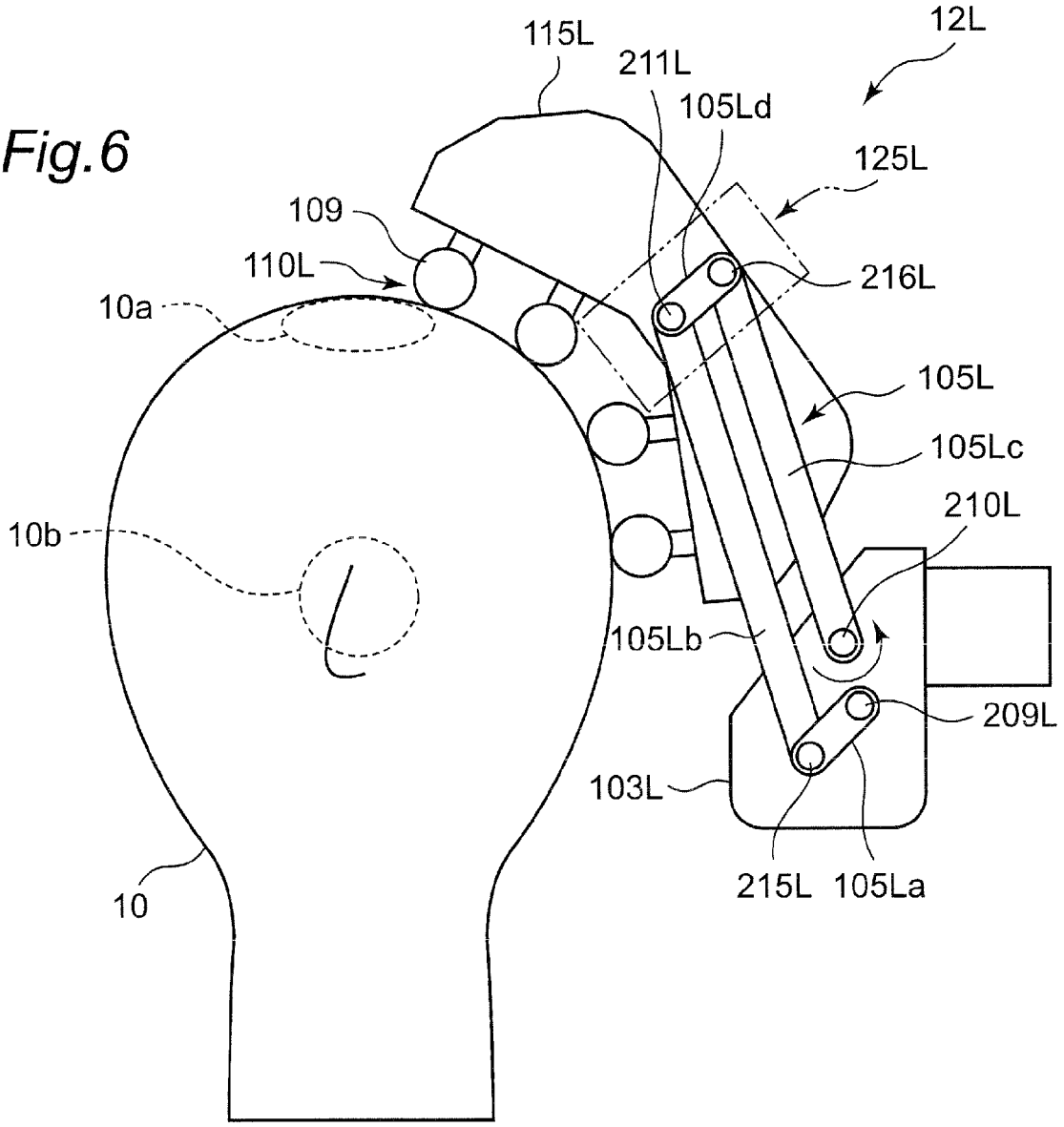
FIG. 6 is a diagram describing a forcing state of the washing unit of the automated hair washing apparatus according to the first embodiment of the invention.

FIG. 6 shows a diagram showing the washing unit in which the automated hair washing apparatus is in contact with the person's head. When washing the person's head 10, the washing unit 12L takes a forcing posture as shown in FIG. 6 in which the actuator 115L, or contacts 109, applies a force against the person's head 10. The force is applied by rotating the second rotating shaft 210L in the counterclockwise direction in the drawing without rotating the first rotating shaft 209L.

A size and/or shape of head 10 varies from person to person, so that the actuator 115L may sometimes be difficult to contact with the top portion 10*a* of the head 10. For this reason, the washing unit 12L of the first embodiment is configured so that the actuator 115L is stretchable away from the unit base 103L, which ensures the actuator 115L to contact with an entire area of the head 10.

The stretching of the actuator 115L away from the unit base 103L is performed using positions of the human's head 10 detected by a position detecting means such as camera, allowing the actuator 115L to reach the top portion 10*a* of the head 10.

Figure 7:
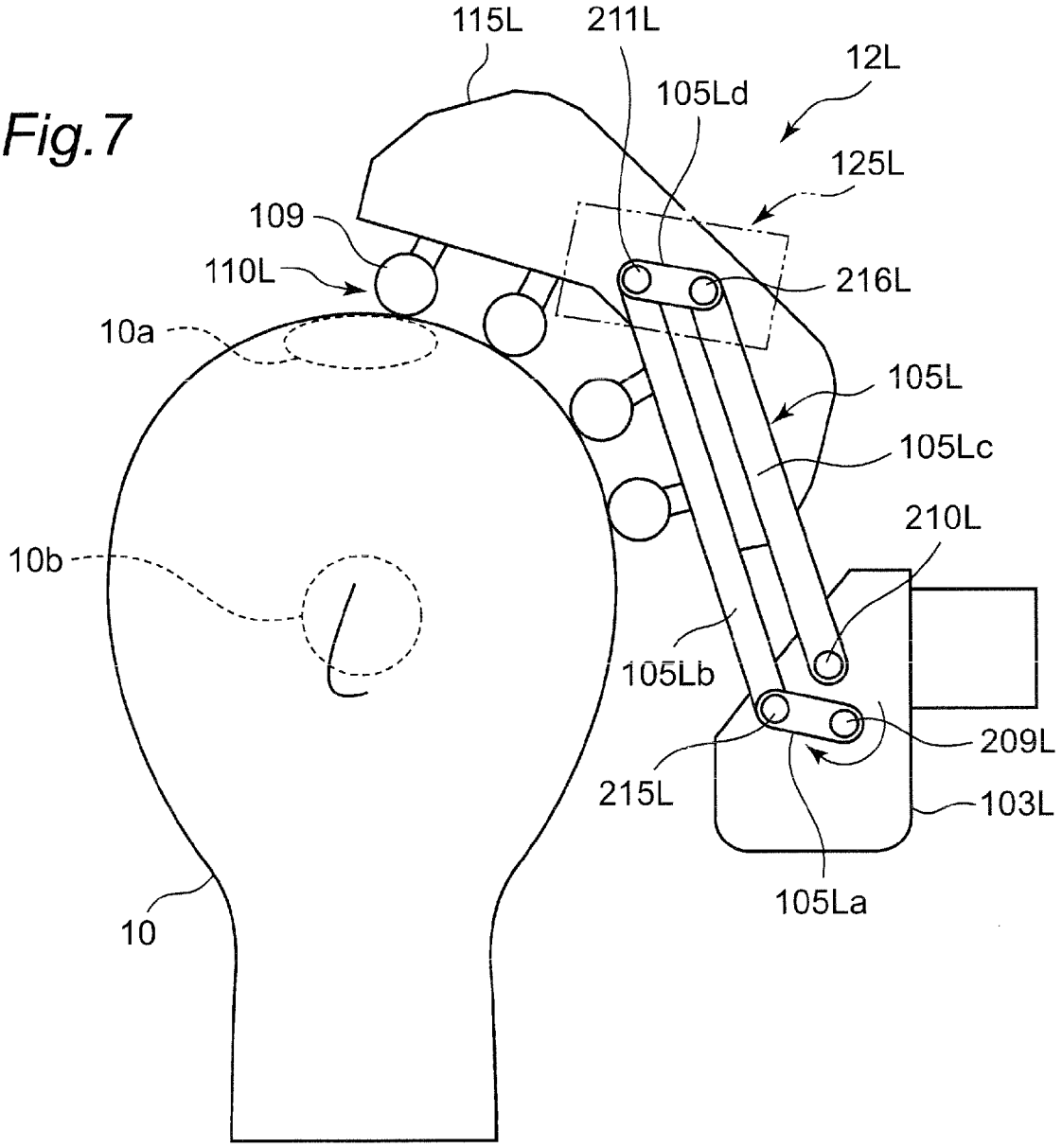
FIG. 7 is a diagram describing a stretching operation of the washing unit of the automated hair washing apparatus according to the first embodiment of the invention.

FIG. 7 is a diagram for use in describing the stretching movement of the washing unit according to the first embodiment of the automated hair washing apparatus.

In the embodiment, when the first rotating shaft 209L rotates in the clockwise direction in the drawing with the second rotating shaft 210L kept stationary, the actuator 115L moves toward the top portion 10*a* of the head 10, namely, the washing unit 12L stretches toward the top portion 10*a* of the head.

The actuator 115L reached the top portion 10*a* may not be oriented toward the central portion 10*b* of the head 10, which makes it impossible for the actuator 115L to make contacts with the person's head 10. For this reason, the first embodiment employs an adjustment mechanism 125L to adjust the posture of the actuator 115L.

Figure 8:
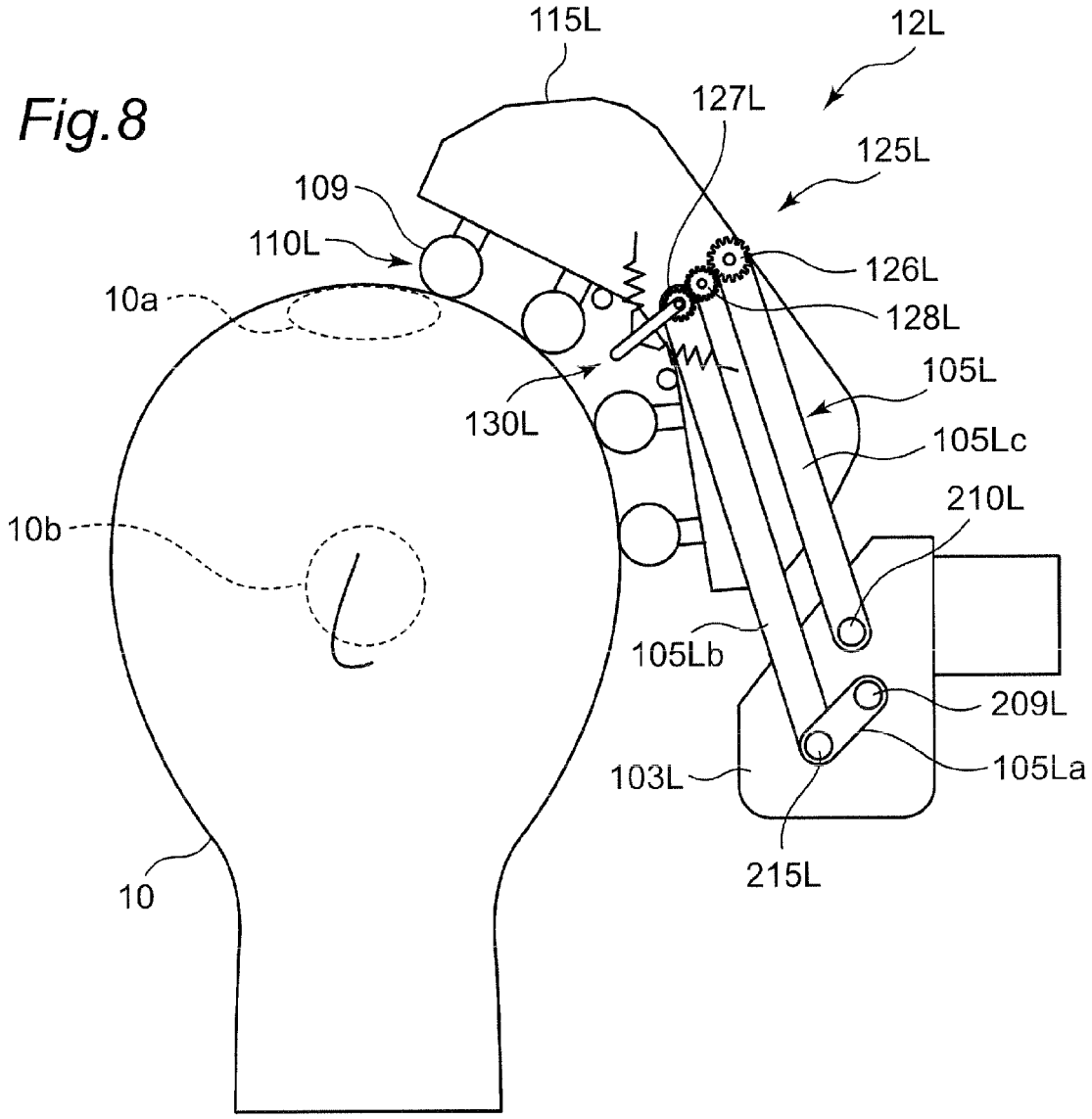
FIG. 8 is a diagram describing the un-stretched washing unit of the automated hair washing apparatus according to the first embodiment of the invention.
Figure 9:
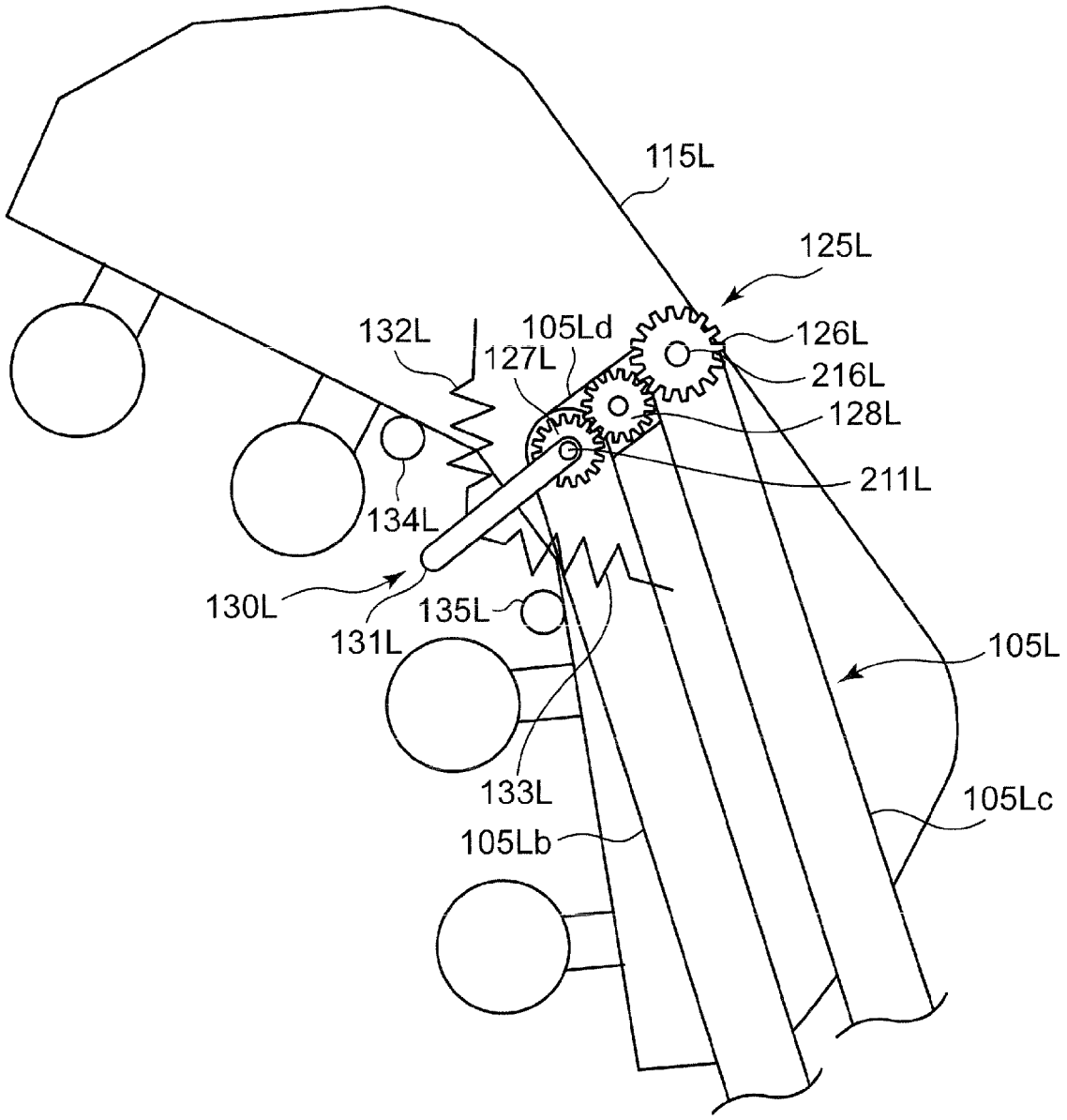
FIG. 9 is an enlarged diagram of the adjustment mechanism shown in FIG. 8.
Figure 10:
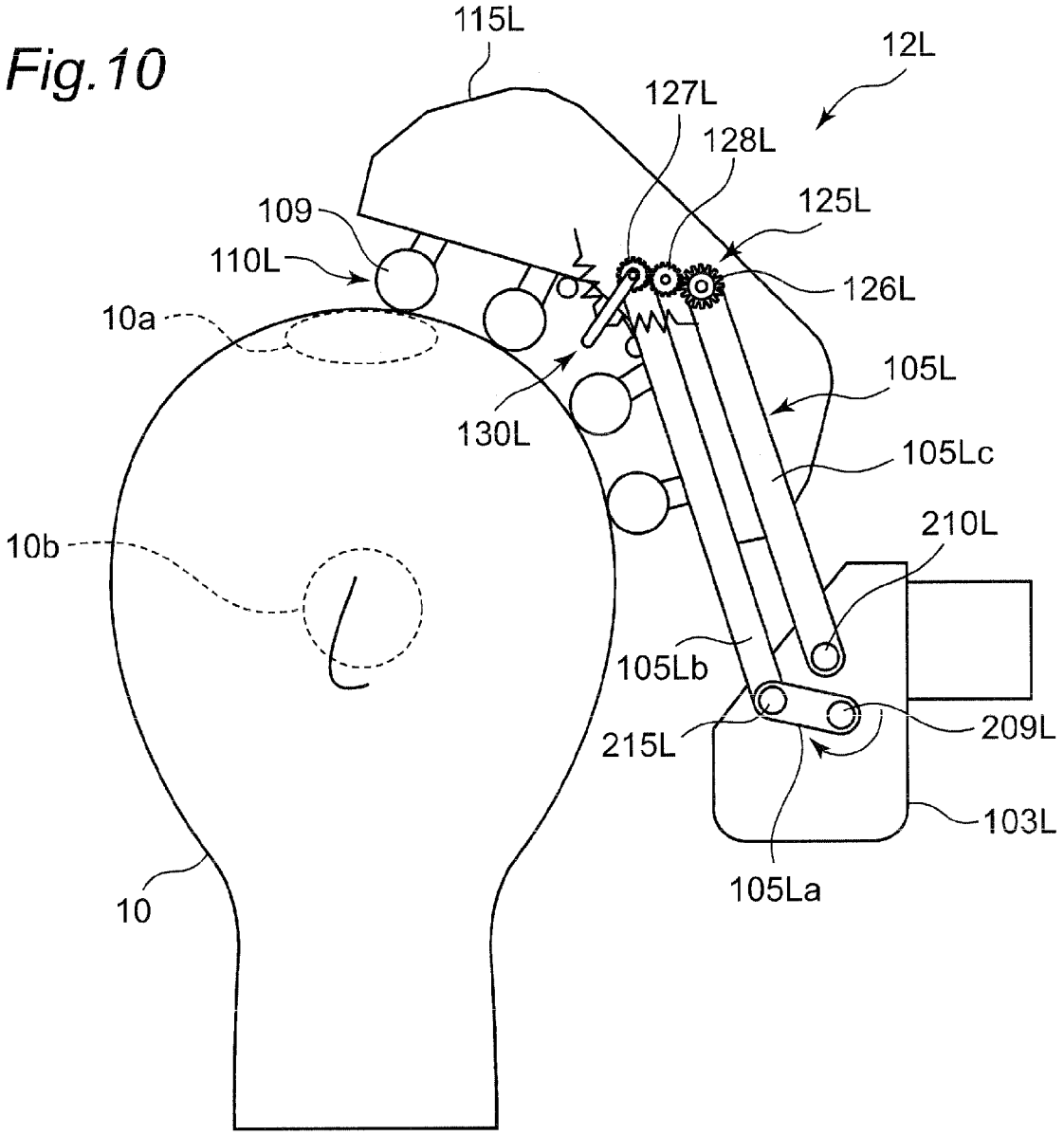
FIG. 10 is a diagram describing the adjustment mechanism and the stretched washing unit of the automated hair washing apparatus according to the first embodiment of the invention.

FIG. 8 is a view showing the unstretched washing unit and the adjustment mechanism of the automated hair washing apparatus according to the first embodiment. FIG. 9 is an enlarged view of the adjustment mechanism in FIG. 8. FIG. 10 is a view showing the stretched washing unit and the adjustment mechanism of the automated hair washing apparatus according to the first embodiment.

The adjustment mechanism 125L rotates at least one of the first and second rotating shafts 209L, 210L to adjust the posture of the actuator 115L so that the portions of the actuator 115L opposing the head 10 posture extend along the head 10. Specifically, the adjustment mechanism 125L adjusts the posture of the actuator 115L relative to the person's head 10 so that the opposing portions of the actuator 115 are oriented toward the central portion 10*b* of the head 10.

As shown in FIGS. 8 and 9, the adjustment mechanism 125L comprises a first adjustment member 126L, a second adjustment member 127L, and an intermediate member 128L connecting between the first and second adjustment members 126L, 127L. The first adjustment member 126L is mounted on the support shaft 216L pivotally connecting between the third and fourth links 105Lc, 105Ld. The second adjustment member 127L is rotatably mounted on the support shaft 211L and fixed to the actuator 115L. The support shaft 211L pivotally connects between the second and fourth links 105Lb, 105Ld.

The first adjustment member 126L and the second adjustment member 127L are rotatable relative to the fourth links 105Ld. A diameter of the first adjustment member 126L is larger than that of the second adjustment member 127L. The intermediate member 128L connects between the first and second adjustment members 126L, 127L so that the first and second adjustment members 126L, 127L rotate in the same direction. For example, the first adjustment member 126L is a first adjustment gear mounted on the support shaft 216L and fixed to the third link 105Lc. For example, the second adjustment member 127L is a second adjustment gear rotatably connected to the support shaft 211L and connected to the actuator 115L. For example, the intermediate member 128L is a third adjustment gear rotatably connected to the fourth link 105Ld and engaged with the first and second adjustment members 126L, 127L.

The intermediate member 128L is positioned between the first and second adjustment members 126L, 127L and rotatably mounted on the fourth link 105Ld at substantially a mid-potion of the fourth link 105Ld. The intermediate member 128L is engaged with the first and second adjustment members 126L, 127L so that the first and second adjustment members 126L, 127L rotate in the same direction relative to the fourth link 105Ld.

The adjustment mechanism 125L comprises an adjustment structure 130L. The adjustment structure 130L comprises an elastic member for adjustment 132L, 133L such as spring connecting between the actuator 115L and the second adjustment member 127L to restrict the posture of the actuator 115L.

The adjustment structure 130L comprises a projection 131L, a first elastic member 132L, and a second elastic member 133L. The projection 131L is fixed to the second adjustment member 127L and extends radially outward from the support shaft 211L. The first elastic member 132L and the second elastic member 133L connect between the projection 131 and the actuator 115L. The first elastic member 132L and the second elastic member 133L are positioned in a symmetric manner relative to the projection 131L so that the biasing forces from the elastic members 132L, 133L are in balance to each other.

Instead of the elastic members 132L, 133L, a rigid member may be used for connecting between the actuator 115L and the second adjustment member 127L in the adjustment structure 130L of the adjustment mechanism 125L.

The adjustment structure 130L comprises a first and second stops 134L, 135L restricting a pivot angle of the actuator 115L to a certain range. The first and second stops 134L, 135L are positioned in a symmetric manner relative to the projection 131L and fixed on the actuator 115L and spaced away from each other.

The adjustment structure 130L allows the projection 131L to bring into contact with the first or the second stop 134L or 135L to restrict the relative pivot movement between the actuator 115L and the second adjustment member 127L in a certain range.

The washing unit 12L is stretched from the unstretched posture in FIG. 8 to the stretched posture in FIG. 10 by rotating the first rotating shaft 209L in the clockwise direction in FIG. 10 with the second rotating shaft 210L retained stationary. In this instance, the third link 105Lc does not move and the fourth link 105Ld pivots in the clockwise direction in FIG. 10 about the support shaft 211L.

Figure 11A:
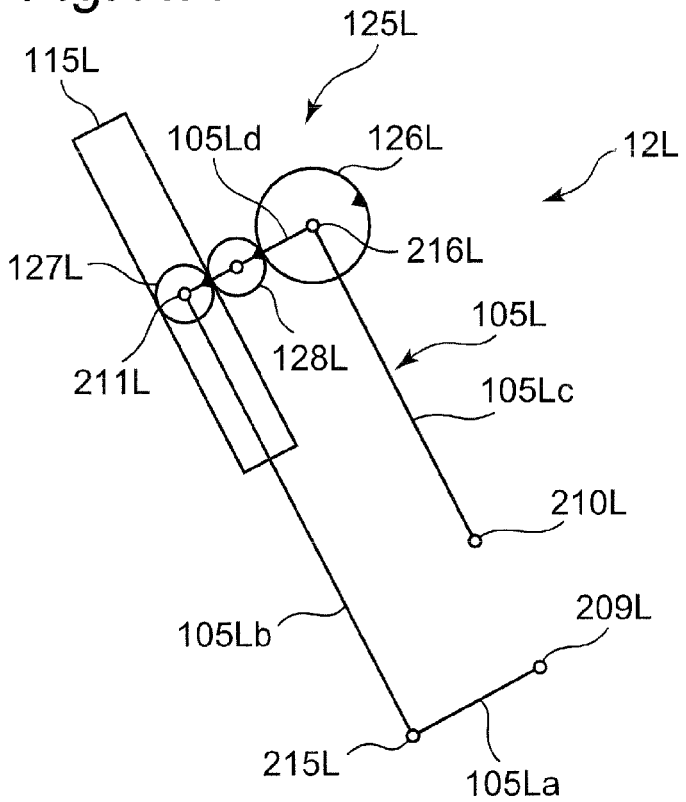
FIG. 11A is a diagram describing movements of the adjustment mechanism and the actuator of the washing unit, caused by the rotation of the first rotating shaft.
Figure 11B:
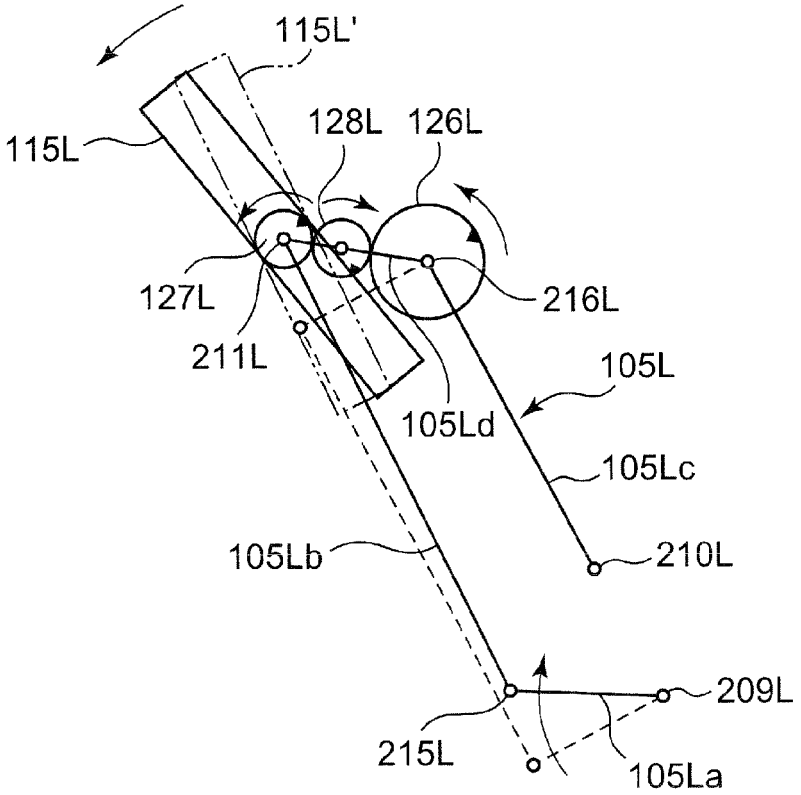
FIG. 11B is a diagram describing movements of the adjustment mechanism and the actuator of the washing unit, caused by the rotation of the first rotating shaft.

FIGS. 11A and 11B are views for use in describing the movement of the actuator in the adjustment mechanism in response to the rotation of the first rotating shaft of the washing unit. FIGS. 11A and 11B illustrate unstretched and stretched washing unit 12L, respectively. FIGS. 11A and 11B schematically illustrate the arm 105L, the actuator 115L, and the adjustment mechanism 125L of the washing unit 12L, in which black triangles are indicated at respective predetermined positions of the first adjustment member 126L, the second adjustment member 127L, and the intermediate member 128L.

When stretching the washing unit 12L, the arm 105L, the actuator 115L, and the adjustment mechanism 125L of the washing unit 12L move as shown in FIGS. 11A and 11B. When the first link 105La, the second link 105Lb, and the fourth link 105Ld move from the positions shown by the dotted lines to the positions shown by solid lines in FIG. 11B, the first adjustment member 126L pivot in the counterclockwise direction relative to the fourth link 105Ld, the intermediate member 128L in the clockwise direction relative to the fourth link 105Ld, and second adjustment member 127L in the counterclockwise direction relative to the fourth link 105Ld. The first adjustment member 126L has a larger diameter than the second adjustment member 127L. Specifically, the pitch circle diameter of the first adjustment member 126L is larger than that of the second adjustment member 127L. With the arrangement, the second adjustment member 127L rotates in the counterclockwise direction relative to the first adjustment member 126L, the projection 131L of the adjustment structure 130L rotates in the counterclockwise direction relative to the unit base 103L, and the actuator 115L rotates in the counterclockwise direction relative to the unit base 103L.

When the washing unit 12L is stretched to move the actuator 115L toward the top portion 10*a* of the head, the actuator 115L causes the adjustment mechanism 125L to adjust the posture of the actuator 115L relative to the person's head 10. Specifically, the actuator 115L is rotated by the adjustment mechanism 125L in the counterclockwise direction from a position which is shown by the long and short dotted lines in FIG. 11B, causing the actuator 115L to oppose the central portion 10*b* of the person's head 10, which ensures the actuator 115L to make contacts with the person's head 10 uniformly. In the drawing, the posture indicated by the long and short dotted lines shows a posture of the actuator 115L' in which no adjustment mechanism is provided.

When the washing unit 12L moves back to its un-stretched posture, it drives in the opposite manner as its stretching. Specifically, the first adjustment member 126L rotates in the clockwise direction relative to the fourth link 105Ld; the intermediate member 128L rotates in the counterclockwise direction relative to the fourth link 105Ld; and the second adjustment member 127L rotates in the clockwise direction relative to the fourth link 105Ld, which results in that the second adjustment member 127L rotates in the clockwise direction relative to the first adjustment member 126L; the projection 131L of the adjustment structure 130L pivots in the clockwise direction relative to the unit base 103L; and the actuator 115L rotates in the clockwise direction relative to the unit base 103L, adjusting the posture of the actuator 115L.

Although in the embodiment shown in FIGS. 8, 10, 11A, and 11B the stretching of the washing unit 12L is performed by rotating the first rotating shaft 209L with the second rotating shaft 210L kept unrotated, it may be done by rotating the second rotating shaft 210L with the first rotating shaft 209L kept unrotated.

Figure 12A:
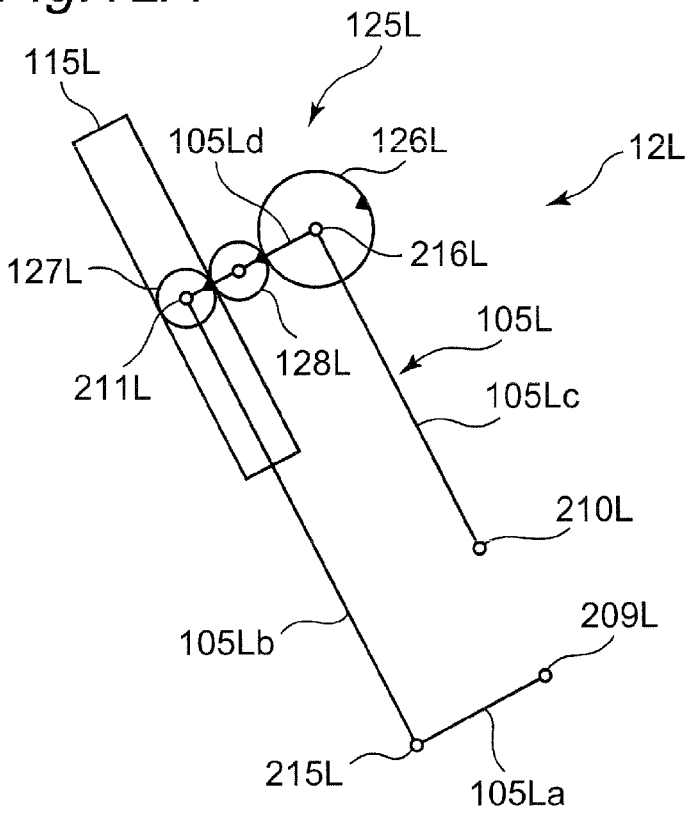
FIG. 12A is a diagram describing movements of the adjustment mechanism and the actuator of the washing unit, caused by the rotation of the second rotating shaft.
Figure 12B:
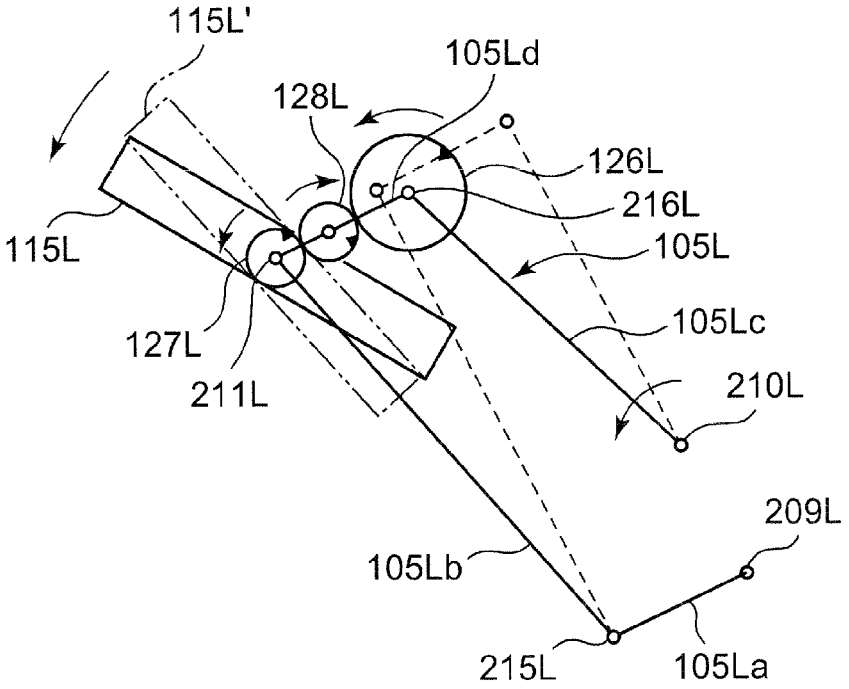
FIG. 12B is a diagram describing movements of the adjustment mechanism and the actuator of the washing unit, caused by the rotation of the second rotating shaft.

FIGS. 12A and 12B illustrate the movements of the actuator due to the rotation of the second rotating shaft of the adjustment mechanism mounted in the washing unit. FIGS. 12A and 12B illustrate the unstretched and stretched washing unit 12L, in which the washing unit 12L is schematically illustrated as in FIGS. 11A and 11B.

As shown in FIGS. 12A and 12B, when stretching the washing unit 12L with the first rotating shaft 209L kept unrotated, the first link 105La does not move and the second link 105Lb pivots about the support shaft 215L in the counterclockwise direction, so that the actuator 115L moves toward the top portion 10*a* of the person's head 10. When the second link 105Lb, the third link 105Lc, and the fourth link 105Ld move from their positions indicated by the dotted lines to their postures indicated by the solid lines in FIG. 12B, the first adjustment member 126L rotates in the counterclockwise direction relative to the fourth link 105Ld; the intermediate member 128L rotates in the clockwise direction relative to the fourth link 105Ld; and the second adjustment member 127L rotates in the counterclockwise direction relative to the fourth link 105Ld. The pitch circle diameter of the first adjustment member 126L is larger than that of the second adjustment member 127L. With this arrangement, the second adjustment member 127L rotates in the counterclockwise direction relative to the first adjustment member 126L; the projection 131L of the adjustment structure 130L pivots in the counterclockwise direction relative to the unit base 103L; and the actuator 115L rotates in the counterclockwise direction relative to the unit base 103L.

By stretching the washing unit 12L to move the actuator 115L toward the top portion 10*a* of the head, the actuator 115L causes the adjustment mechanism 125L to adjust the posture of the actuator 115L relative to the person's head 10. Specifically, the actuator 115L is rotated by the adjustment mechanism 125L in the counterclockwise direction from a posture which is shown by the long and short dotted lines in FIG. 12B, causing the actuator 115L to oppose the central portion 10*b* of the person's head 10. In the drawing, the posture indicated by the long and short dotted lines shows a posture of the actuator 115L' in which no adjustment mechanism is provided. This allows that the actuator 115L contacts the person's head 10 uniformly.

When the second rotating shaft 210L rotates in the clockwise direction, with the first rotating shaft 209L kept unrotated, to move the washing unit 12L into the unstretched posture, it drives in the opposite manner than stretching. Specifically, the first adjustment member 126L rotates in the clockwise direction relative to the fourth link 105Ld; the intermediate member 128L rotates in the counterclockwise direction relative to the fourth link 105Ld; and the second adjustment member 127L rotates in the clockwise direction relative to the fourth link 105Ld.

The first and second adjustment members 126L and 127L are designed so that the diameter of the first adjustment member 126L is larger than that of the second adjustment member 127L. This results in that the second adjustment member 127L rotates in the clockwise direction relative to the first adjustment member 126L; the projection 131L of the adjustment structure 130L pivots in the clockwise direction relative to the unit base 103L; and the actuator 115L rotates in the clockwise direction relative to the unit base 103L, which adjusts the posture of the actuator 115L. An amount of adjustment can be varied by changing the ratio of the pitch circle diameters of the first and second adjustment members 126L and 127L.

Although when stretching the washing unit 12L one of the first and second rotating shafts 209L or 210L is rotated while the other is kept unrotated in the previous embodiment, the first and second rotating shafts 209L and 210L may be rotated simultaneously for stretching. For example, the washing unit 12L is stretched by rotating the first and second rotating shafts 209L and 210L in opposite directions. Also, the washing unit 12L can be stretched by rotating the first and second rotating shafts 209L and 210L in the same direction. In those instances, the adjustment mechanism 125L adjusts the posture of the actuator 115L when at least one of the first and second rotating shafts 209L and 210L is rotated.

As described above, the washing unit 12L is stretched relative to the unit base 103L and thereby the posture of the actuator 115L is adjusted so that it opposes to and extend along the person's head 10. This allows that, for persons with different head shapes and sizes, the actuator 115L is stretched to extend along and have contact with their heads 10, which in turn ensures reliable washing of the heads.

The right washing unit 12R is constructed similar to the left washing unit 12L. The right washing unit 12R comprises an actuator 115R for washing the person's head 10, an arm 105R supporting the actuator 115R, a unit base 103R supporting the arm 105R, an adjustment mechanism 125R adjusting a posture of the actuator 115R relative to the person's head 10, and a pipe 111R fixed to the unit base 103R.

As shown in FIG. 2, a support shaft 104R of the right washing unit 12R is rotatably mounted on the bowl 101 through the support column 102R so that the washing unit 12R can pivot around the support shaft 104R. The support column 102R comprises therein a motor 202R connected to the support shaft 104R. The pipe 111R is constructed similar to the pipe 111L. The actuator 115R is constructed similar to the actuator 115L. The actuator 115R is connected to the support shaft 211R through the adjustment mechanism 125R and retained in posture relative to the support shaft 211R. The arm 105R is constructed similar to the arm 105L. The arm 105R comprises first and second rotating shafts 209R and 210R each of which is capable of rotating independently. The first and second rotating shafts 209R and 210R are rotatably supported by the unit base 103R. The adjustment mechanism 125R is constructed similar to the adjustment mechanism 125L so that, when at least one of the first and second rotating shafts 209R and 210R is rotated, the actuator 115R adjusts its posture to oppose and extend along person's head 10.

The washing units 12L and 12R so constructed are controlled by the controller 400 to perform the forcing, stretching, swinging, and kneading actions.

The forcing action of the washing unit 12L, 12R is to rotate the second rotating shaft 210L, 210R of the arm 105L, 105R to move the actuator 115L, 115R toward and away from the person's head 10, i.e., in the forcing or releasing direction.

The stretching action of the washing unit 12L, 12R is to rotate the first rotating shaft 209L, 209R and the second rotating shaft 210L, 210R of the arms 105L, 105R to stretch the actuator 115L, 115R toward and un-stretch it away from the unit base 103L, 103R.

The swinging action of the washing unit 12L, 12R is to rotate the support shaft 104L, 104R of the arm 105L, 105R and thereby to rotate washing unit 12L, 12R about the support shaft 104L, 104R, moving the actuator 115L, 115R to the front and rear sides of the person's head 10.

The kneading action of the washing unit 12L, 12R is to drive the motor positioned within the actuator 115L, 115R to swing the contacts 109 of the actuator 115L, 115R.

The automated hair washing apparatus 100 washes the person's head 10 by performing the forcing, stretching, swinging, and kneading actions independently or in combination.

The automated hair washing machine 100 according to the first embodiment of the invention can work as a head care apparatus. In this instance, the head care apparatus is used not only to wash the person's head 10 automatically but also to massage the person's head by the contacts 109 without ejecting cleaning liquid or water from the nozzles 112.

The first embodiment of the automated hair washing apparatus 100 may have a cover covering the adjustment mechanism 125L. In addition to this cover, another cover may be provided for covering the arm 105L. Instead of the cover covering the adjustment mechanism 125L only, a cover covering both the adjustment mechanism 125L and the arm 105L may be provided. The cover covering the adjustment mechanism 125L only or both the adjustment mechanism 125L and the arm 105L prevents the adjustment mechanism 125L and/or the arm 105L from interfering with other members, which in turn ensures a reliable movements of the adjustment mechanism 125L and/or the arm 105L.

Second Embodiment

Next, an automated hair washing apparatus according to the second embodiment of the invention will be described below. Only portions of the automated hair washing apparatus of this embodiment having structures different from those of corresponding portions of the previous embodiment will be described, and other portions of this embodiment similar to those of corresponding portions of the previous embodiment will not be described.

Figure 13A:
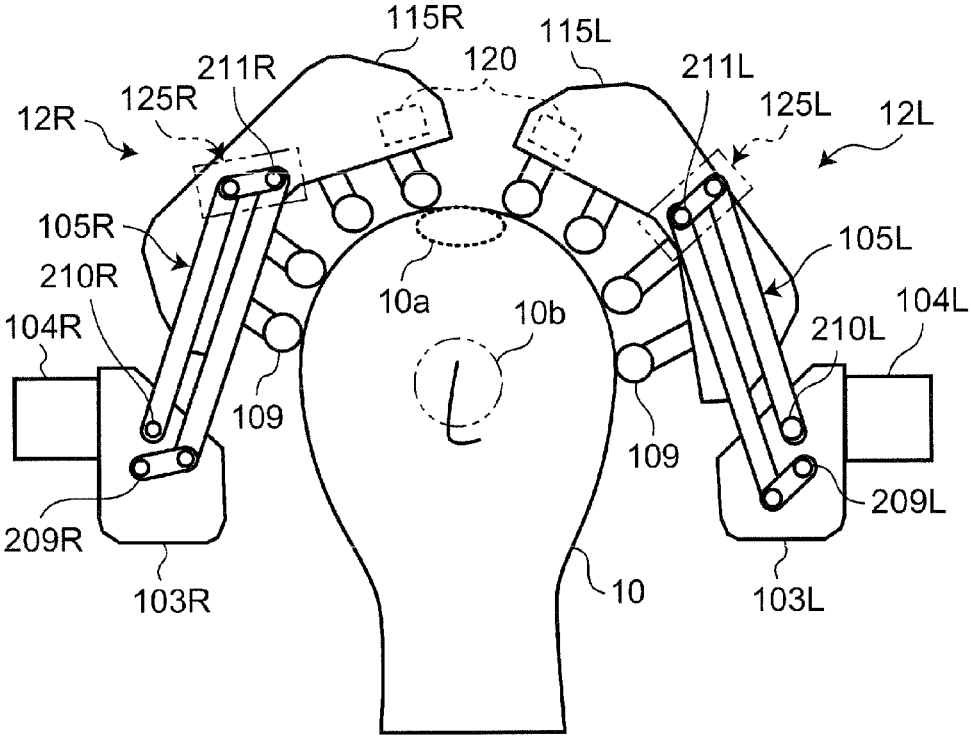
FIG. 13A is a diagram showing the automated hair washing apparatus according to the second embodiment of the invention.
Figure 13B:
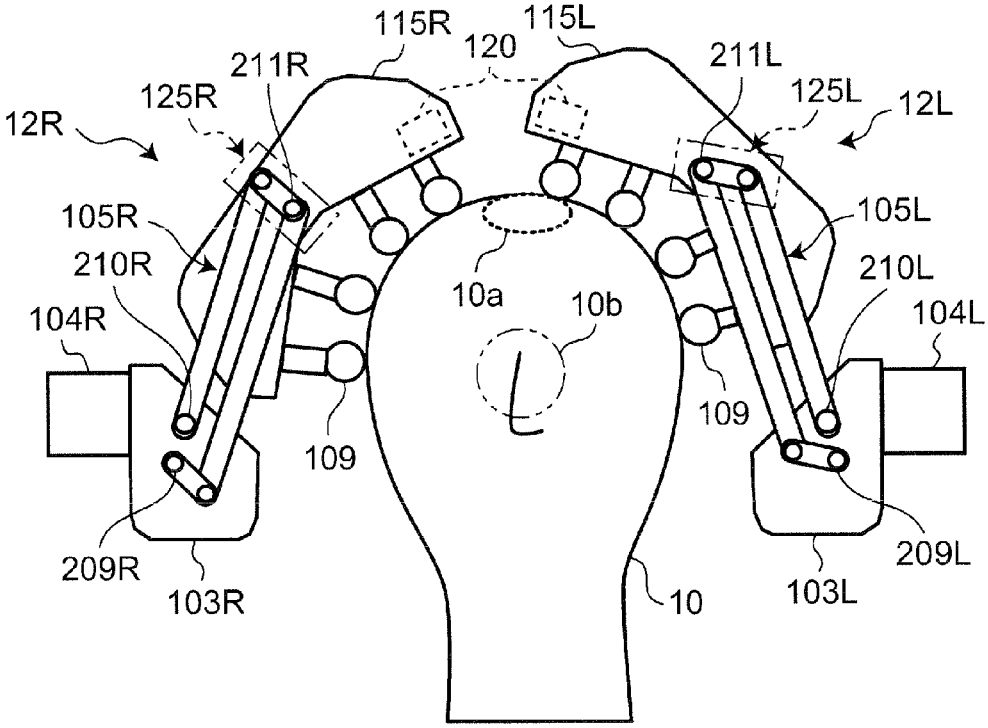
FIG. 13B is a diagram describing an operation of the washing unit of the automated hair washing apparatus according to the second embodiment of the invention.

FIGS. 13A and 13B are diagrams describing the movements of the automated hair washing apparatus according to the second embodiment of the invention. In the automated hair washing apparatus of this embodiment, the actuators 115L, 115R of the washing units 12L, 12R comprise distance detectors 120 detecting a distance between the actuators 115L, 115R.

In this embodiment, the controller 400 controls the movements of the washing units 12L, 12R using the distance between the actuators 115L, 115R detected by the distance detector 120. For example, the washing units 12L, 12R are controlled so that the washing unit 12L in FIG. 13B and the washing unit 12R in FIG. 13A are alternately and repeatedly stretched and un-stretched while keeping a certain distance between the actuators 115L, 115R to move the actuators 115L, 115R up to respective positions adjacent the top portion 10*a* of the person's head 10 and thereby wash the head 10 entirely. This allows that the person's head 10 can be washed without causing interference between the actuators 115L, 115R.

Third Embodiment

Next, an automated hair washing apparatus according to the third embodiment of the invention will be described below. Only portions of the automated hair washing apparatus of this embodiment having structures different from those of corresponding portions of the previous embodiment will be described, and other portions of this embodiment similar to those of corresponding portions of the previous embodiment will not be described.

Figure 14:
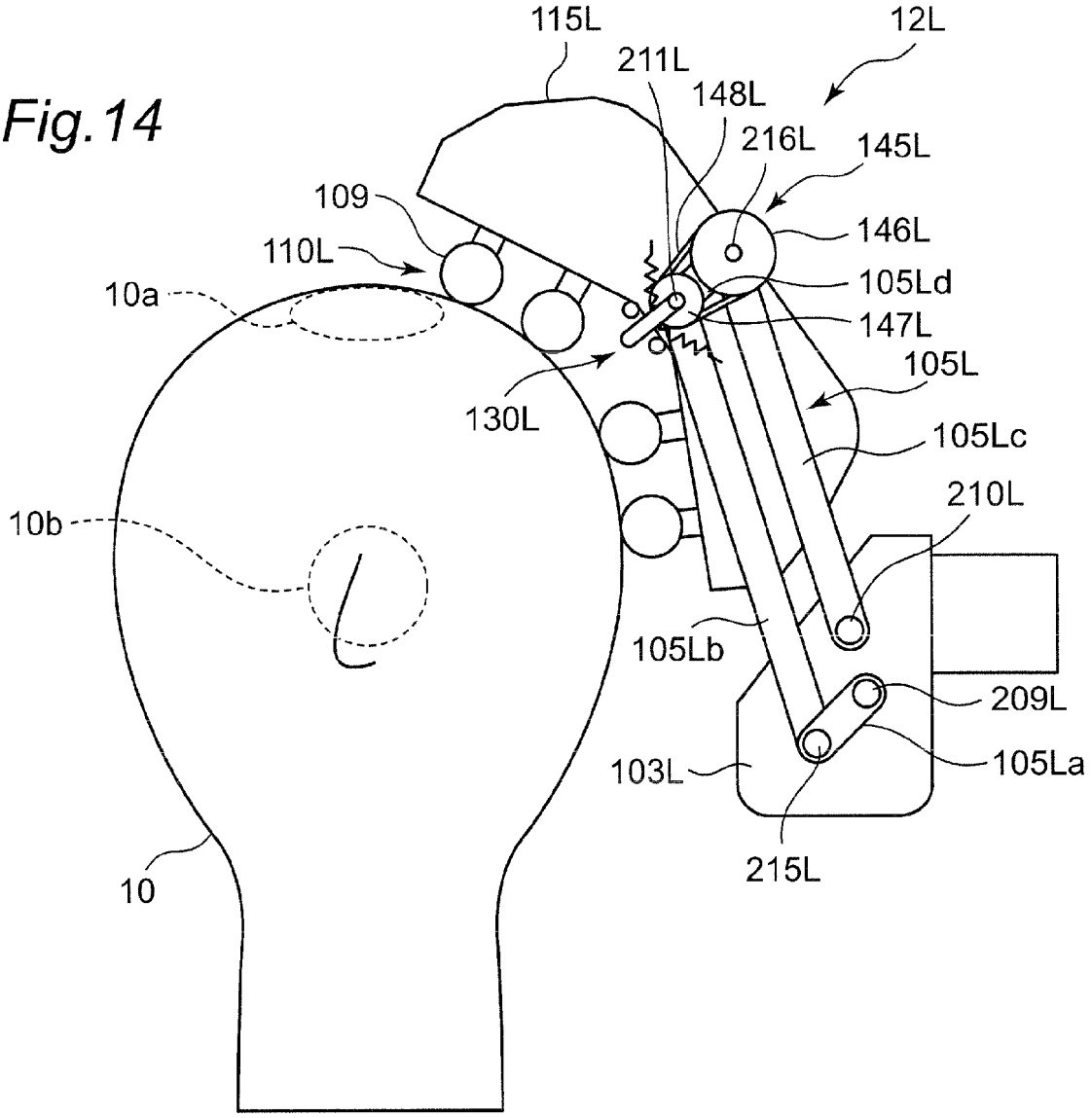
FIG. 14 is a side view showing the washing unit of the automated hair washing apparatus according to the third embodiment of the invention.

FIG. 14 is a side view of the automated hair washing apparatus according to the third embodiment of the invention. The left and right washing units 12L, 12R of this embodiment are constructed in the same way and then only one washing unit 12L will be described below. As shown in FIG. 14, the washing unit 12L of the automated hair washing apparatus according to this embodiment comprises an adjustment mechanism 145L adjusting the posture of the actuator 115L relative to the person's head 10.

The adjustment mechanism 145L comprises a first adjustment member 146L rotatably mounted on the support shaft 216L pivotally connecting between the third and fourth links 105Lc, 105Ld and fixed to the third link 105Lc, a second adjustment member 147L rotatably mounted on the support shaft 211L pivotally connecting between the second and fourth links 105Lb, 105Ld and connected to the actuator 115L, and an intermediate member 148L connecting between the first and second adjustment members 146L, 147L.

The first and second adjustment members 146L, 147L are rotatable relative to the fourth link 105Ld. A diameter of the first adjustment member 146L is larger than that of the second adjustment member 147L. The intermediate member 148L connects between the first and second adjustment members 146L, 147L so that they pivot in the same direction relative to the fourth link 105Ld.

The first adjustment member 146L of the adjustment mechanism 145L of the third embodiment is, for example, a first adjustment pulley mounted on the support shaft 211L and fixed to the third link 105Lc. The second adjustment member 147L is, for example, a second adjustment pulley rotatably mounted on the support shaft 216L and connected to the actuator 115L. The intermediate member 148L is, for example, an adjustment belt entrained on the first and second adjustment members 146L, 147L connecting between the first and second adjustment members 146L, 147L. The intermediate member 148L is configured to rotate the first and second adjustment members 146L, 147L in the same direction relative to the fourth link 105Ld.

Similar to the adjustment mechanism 125L, the adjustment mechanism 145L further comprises an adjustment structure 130L. The adjustment structure 130L connects between the actuator 115L and the second adjustment member 147L to restrict the movement of the actuator 115L. The adjustment structure 130L comprises elastic members for adjustment 132L, 133L made of spring, for example, connecting between the actuator 115L and the second adjustment member 127L.

Fourth Embodiment

Next, an automated hair washing apparatus according to the fourth embodiment of the invention will be described below. Only portions of the automated hair washing apparatus of this embodiment having structures different from those of corresponding portions of the previous embodiment will be described, and other portions of this embodiment similar to those of corresponding portions of the previous embodiment will not be described.

Figure 15:
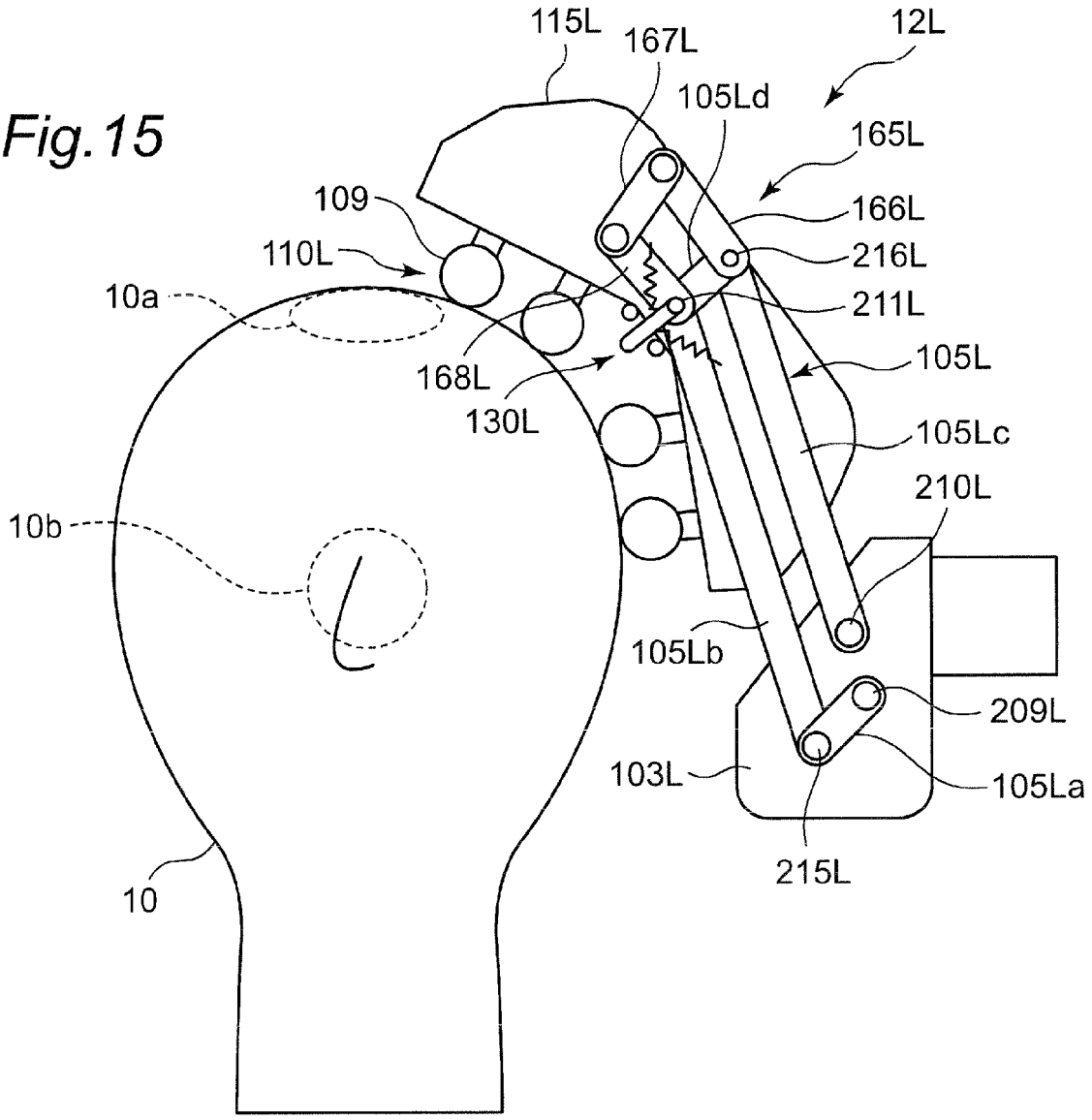
FIG. 15 is a side view showing the washing unit of the automated hair washing apparatus according to the fourth embodiment of the invention.

FIG. 15 is a side view of the automated hair washing apparatus according to the fourth embodiment of the invention. As shown in FIG. 15, the washing unit 12L of the automated hair washing apparatus according to this embodiment comprises an adjustment mechanism 165L adjusting the posture of the actuator 115L relative to the person's head 10.

The adjustment mechanism 165L comprises a first adjustment link 166L, a second adjustment link 167L, and a third adjustment link 168L. The first adjustment link 166L is connected at its one end to the support shaft 216L pivotally connecting between the third and fourth links 105Lc, 105Ld and fixed to the third links 105Lc. The second link 167L is pivotally connected at its one end to the opposite end of the first adjustment link 166L. The third link 168L is pivotally connected at its one end to the other end of the second adjustment link 167L and also pivotally connected at its opposite end to the support shaft 211L.

Each of the first, second, and third links 116L, 167L, 168L is a straight bar. The first, second, and third adjustment links 166L, 167L, 168L are connected so that the second adjustment link 167L moves away from the unit base 103L more than the fourth adjustment link 105Ld. The first and second adjustment links 166L, 168L are formed that the first adjustment link 166L is longer than the third adjustment link 168L.

Similar to the adjustment mechanism 125L, the adjustment mechanism 165L further comprises an adjustment structure 130L connecting between the actuator 115L and the third link 168L to restrict the movement of the actuator 115L. The adjustment structure 130L connects between the actuator 115L and the third link 168L through elastic members for adjustment 132L, 133L made of, for example, spring.

The adjustment structure 130L of the adjustment mechanism 165L is adapted so that, when the actuator 115L rotates relative to the third adjustment link 168L, the adjustment projection 131L abuts the first adjustment stop 134L or the second adjustment stop 135L to limit the rotational angles of the actuator 115 and the third link 168L within respective ranges.

According to the automated hair washing apparatus of this embodiment, when the first rotating shaft 209L rotates in the clockwise direction in FIG. 15 while the second rotating shaft 210L is kept stationary and thereby to stretch the washing unit 12L, the fourth link 105Ld pivots about the support shaft 216L in the clockwise direction in FIG. 15 while the third link 105Lc is kept stationary, causing the actuator 115L supported by the support shaft 211L to move toward the top portion 10*a* of the person's head 10. When the first rotating shaft 209L is rotated while the second rotating shaft 210L is kept stationary to stretch the washing unit 12L, the second adjustment link 167L pivots in the clockwise direction relative to the first adjustment link 166L and the third link 168L pivots in the counterclockwise direction relative to the second adjustment link 167L. The first adjustment link 166L is longer than the third adjustment link 168L. With the arrangement, the third adjustment link 168L pivots in the counterclockwise direction relative to the first adjustment link 166L and the actuator 115L rotates in the counterclockwise direction relative to the unit base 103L.

When the washing unit 12L is stretched to move the actuator 115L toward the top portion 10*a* of the head, the actuator 115L is rotated by the adjustment mechanism 165L in the counterclockwise direction and the posture of the actuator 115L relative to the person's head 10 is adjusted so that the actuator 115L opposes the central portion 10*b* of the person's head 10, allowing the actuator 115L to contact with the person's head more uniformly.

When the washing unit 12L is un-stretched, it drives in an opposite manner than stretching in which the second adjustment link 167L pivots in the counterclockwise direction relative to the first adjustment link 166L and the third adjustment link 168L in the clockwise direction relative to the second adjustment link 167L.

Fifth Embodiment

Next, an automated hair washing apparatus according to the fifth embodiment of the invention will be described below. Only portions of the automated hair washing apparatus of this embodiment having structures different from those of corresponding portions of the previous embodiment will be described, and other portions of this embodiment similar to those of corresponding portions of the previous embodiment will not be described.

Figure 16:
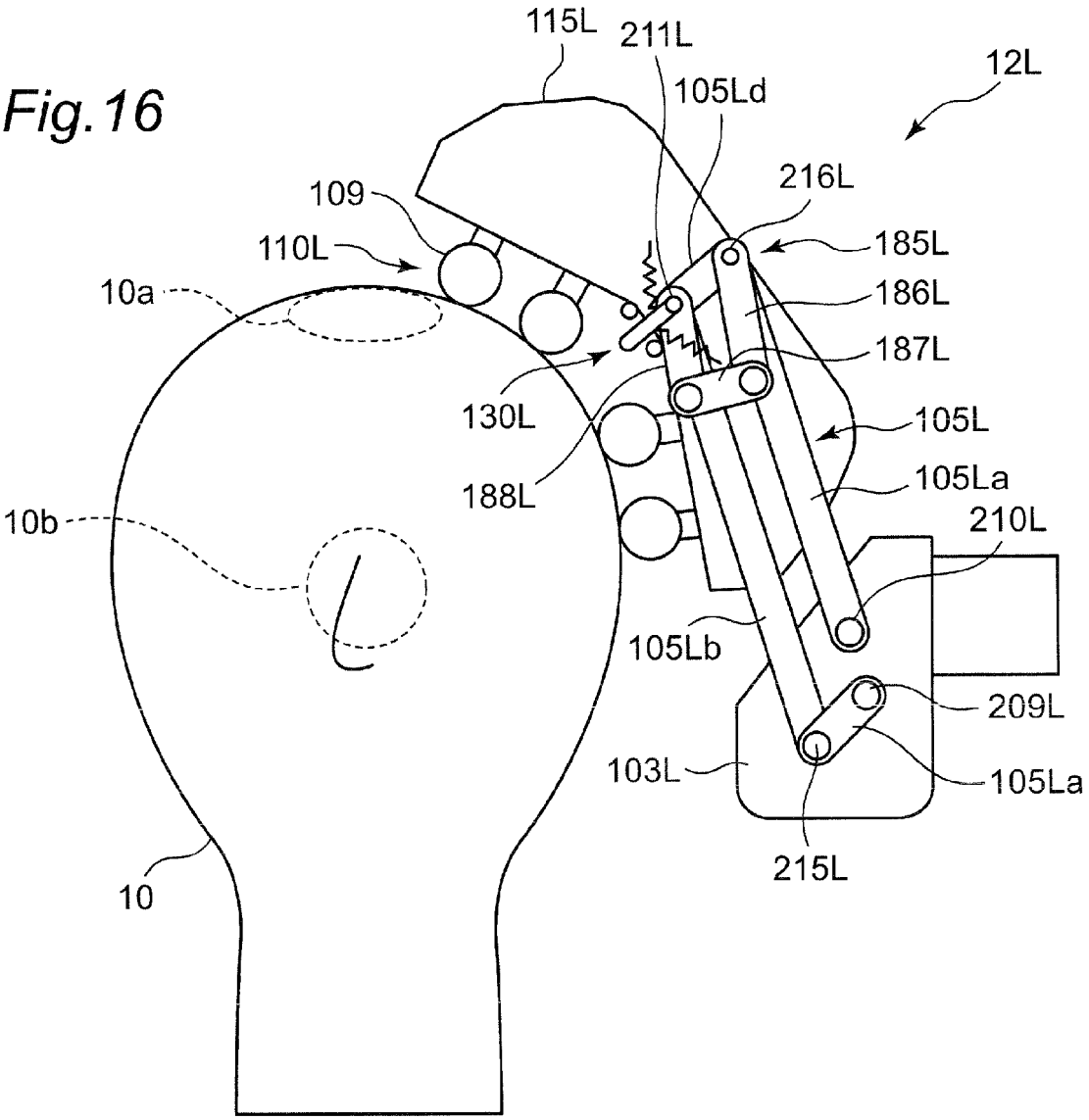
FIG. 16 is a side view showing the washing unit of the automated hair washing apparatus according to the fifth embodiment of the invention.
Figure 17:
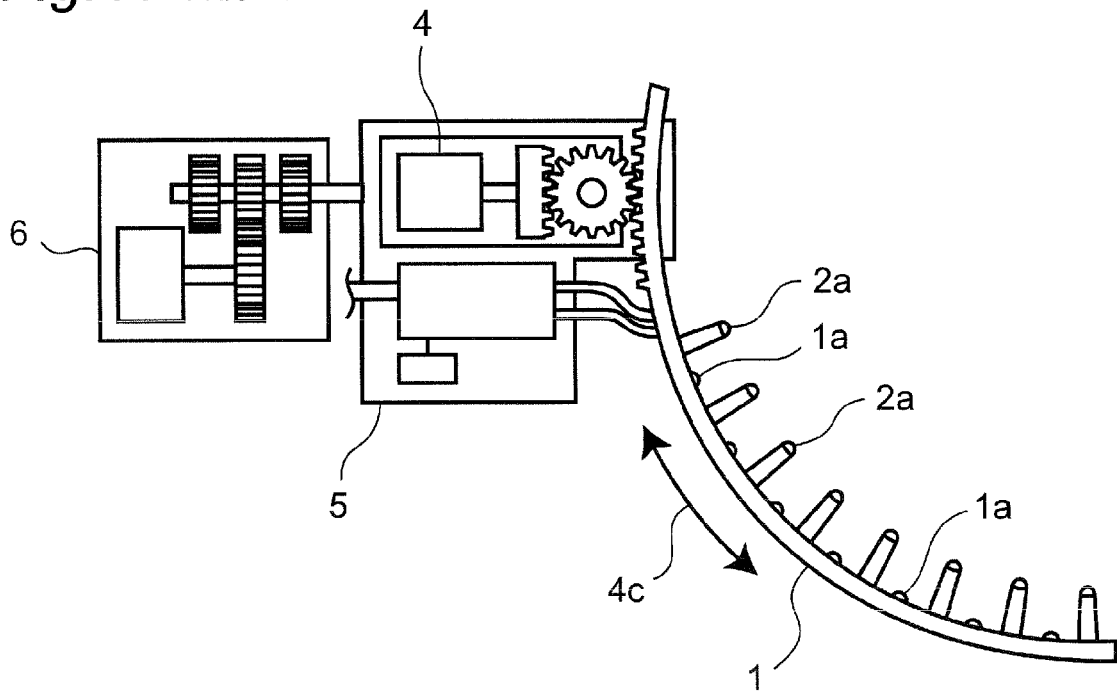
Fig. 17 PRIOR ART
FIG. 17 is a diagram schematically showing a major part of the automated head washing apparatus indicated in a patent literature 1.

FIG. 16 is a side view of the automated hair washing apparatus according to the fifth embodiment of the invention. As shown in FIG. 16, the washing unit 12L of the automated hair washing apparatus according to this embodiment comprises an adjustment mechanism 185L adjusting the posture of the actuator 115L relative to the person's head 10.

The adjustment mechanism 185L comprises first, second, and third adjustment links 186L, 187L, and 188L. The first, second, and third adjustment links 186L, 187L, and 188L of the adjustment mechanism 185L are arranged so that the second adjustment link 187L approaches the unit base 103L more than the fourth link 105Ld. The first, second, and third adjustment links 186L, 187L, and 188L are constructed as the first, second, and third adjustment links 166L, 167L, 168L of the adjustment mechanism 165L.

The present invention is not limited to the above-described embodiments and can be modified and improved in various ways without departing from the gist of the invention.

INDUSTRIAL APPLICABILITY

The head care apparatus of the invention is applicable in various fields such as medical and cosmetic industries for taking care of person's heads.

Parts List

10: head
10*a*: top portion of head
10*b*: center of head
11: first support
12, 12L, 12R: washing unit
100: automated hair washing unit
101: bowl
102L, 102R: support column
103L, 103R: unit base
104L, 104R: support shaft
105L, 105R: arm
105La: first link
105Lb: second link
105Lc: third link
105Ld: fourth link
109: contact
110L, 110R: contact portion
111L, 111R: pipe
112: nozzle
115L, 115R: actuator
118L, 118R: five-bar link mechanism
125L, 125R, 145L, 165L, 185L: adjustment mechanism
126L, 146L: first adjustment member
127L, 147L: second adjustment member

128L, 148L: intermediate member
130L: adjustment structure
131L: projection
132L: first elastic member
133L: second elastic member
134L: first adjustment stop
135L: second adjustment stop
166L, 186L: first adjustment link
167L, 187L: second adjustment link
168L, 188L: third adjustment link
209L, 209R: first rotating shaft
210L, 210R: second rotating shaft
211L, 211R, 215L, 216L: support shaft
400: controller

The invention claimed is:

1. A head care apparatus comprising:
a first support for supporting a back of person's head;
a unit base including a first rotating shaft and a second rotating shaft, each of the first and second rotating shafts being rotatable independently;
a first link, one end of the first link being connected to the first rotating shaft;
a second link, one end of the second link being connected to the other end of the first link;
a third link, one end of the third link being connected to the second rotating shaft;
a fourth link, one end of the fourth link being pivotally connected to the other end of the third link;
an operation shaft pivotally connecting between the other end of the second link and the other end of the fourth link;
an actuator supported by the operation shaft for caring the person's head supported on the first support; and
an adjustment mechanism adjusting a posture of the actuator relative to the person's head on the first support;
the adjustment mechanism comprising
a connection shaft pivotally connecting between the third and fourth links;
a first adjustment member mounted on the connection shaft and fixed to the third link;
a second adjustment member rotatably connected to the operation shaft and fixed to the actuator; and
an intermediate member connecting between the first and second adjustment members and causing the first and second adjustment members to rotate in a direction relative to the fourth link;
the posture of the actuator being adjusted by either one of or both of the rotations of the first and second rotating shafts.

2. The head care apparatus of claim 1, wherein each of the first and second adjustment members is rotatable relative to the fourth link, and the first and second adjustment members have respective diameters, the diameter of the first adjustment member being larger than the diameter of the second adjustment member.

3. The head care apparatus of claim 1, wherein the adjustment mechanism is configured to adjust the posture of the actuator so that the actuator becomes to extend along the person's head supported on the first support by the rotation of at least one of the first and second rotating shafts.

4. The head care apparatus of claim 1, further comprising an adjustment structure connecting between the actuator and the second adjustment member to restrict the posture of the actuator.

5. The head care apparatus of claim 1, further comprising an adjustment structure, the adjustment structure including an elastic member connecting the actuator and the second adjustment member.

6. The head care apparatus of claim 1, wherein
the first adjustment member comprises a first adjustment gear mounted on the connection shaft pivotally connecting the third and fourth links and fixed to the third link,
the second adjustment member comprises a second adjustment gear rotatably connected to the operation shaft and fixed to the actuator;
the intermediate adjustment member comprises a third adjustment gear rotatably connected to the fourth link and engaged with the first and second adjustment gears.

7. The head care apparatus of claim 6, wherein the adjustment mechanism comprises an adjustment structure, the adjustment structure including an elastic member connecting the actuator and the second adjustment member.

8. The head care apparatus of claim 1, wherein
the first adjustment member comprises a first adjustment pulley mounted on the connection shaft pivotally connecting the third and fourth links and fixed to the third link,
the second adjustment member comprises a second adjustment pulley rotatably connected to the operation shaft and fixed to the actuator;
the intermediate adjustment member comprises an adjustment belt entrained on the first and second adjustment pulleys connecting between the first and second adjustment pulleys.

9. The head care apparatus of claim 8, wherein the adjustment mechanism comprises an adjustment structure, the adjustment structure including an elastic member connecting the actuator and the second adjustment pulley.

10. The head care apparatus in claims 1, wherein the actuator comprises a contact mounted on a portion of the actuator opposing the person's head for caring the person's head on the first support.

11. The head care apparatus of claim 10, wherein the actuator comprises a washing unit for washing the person's head on the first support.

12. A head care apparatus comprising:
a first support for supporting a back of person's head;
a unit base including a first rotating shaft and a second rotating shaft, each of the first and second rotating shafts being rotatable independently;
a first link, one end of the first link being connected to the first rotating shaft;
a second link, one end of the second link being connected to the other end of the first link;
a third link, one end of the third link being connected to the second rotating shaft;
a fourth link, one end of the fourth link being pivotally connected to the other end of the third link;
an operation shaft pivotally connecting between the other end of the second link and the other end of the fourth link;
an actuator supported by the operation shaft for caring the person's head supported on the first support; and
an adjustment mechanism adjusting a posture of the actuator relative to the person's head on the first support;
the adjustment mechanism comprising
a connection shaft pivotally connecting between the third and fourth links;
a first adjustment link, one end of the first adjustment link being connected to the connection shaft and fixed to the third link;

a second adjustment link, one end of the second adjustment link being pivotally connected to the other end of the first adjustment link;

a third adjustment link, one end of the third adjustment link being pivotally connected to the other end of the second adjustment link and the other end of the third adjustment link being pivotally connected to the operation shaft; and an adjustment structure connecting between the actuator and the third link to restrict the posture of the actuator;

the posture of the actuator being adjusted by either one of or both of the rotations of the first and second rotating shafts.

13. The head care apparatus of claim 12, wherein the first adjustment link is longer than the third adjustment link.

14. The head care apparatus of claim 12, further comprising an adjustment structure, the adjustment structure having an elastic member connecting between the actuator and the third adjustment link.

* * * * *